US005890378A

United States Patent [19]

Rambo et al.

[11] Patent Number: 5,890,378

[45] Date of Patent: Apr. 6, 1999

[54] HYDROCARBON GAS PROCESSING

[75] Inventors: C. L. Rambo; John D. Wilkinson; Hank M. Hudson, all of Midland; Michael C. Pierce, Odessa, all of Tex.

[73] Assignee: Elcor Corporation, Dallas, Tex.

[21] Appl. No.: 52,845

[22] Filed: Mar. 31, 1998

[51] Int. Cl.[6] ..... F25J 3/00

[52] U.S. Cl. ..... 62/621; 62/630

[58] Field of Search ..... 62/621, 630

[56] References Cited

U.S. PATENT DOCUMENTS

| | | |
|---|---|---|
| Re. 33,408 | 10/1990 | Khan et al. . |
| 4,157,904 | 6/1979 | Campbell et al. . |
| 4,171,964 | 10/1979 | Campbell et al. . |
| 4,251,249 | 2/1981 | Gulsby . |
| 4,278,457 | 7/1981 | Campbell et al. . |
| 4,519,824 | 5/1985 | Huebel . |
| 4,617,039 | 10/1986 | Buck . |
| 4,687,499 | 8/1987 | Aghili . |
| 4,689,063 | 8/1987 | Paradowski et al. . |
| 4,690,702 | 9/1987 | Paradowski et al. . |
| 4,854,955 | 8/1989 | Campbell et al. . |
| 4,869,740 | 9/1989 | Campbell et al. . |
| 4,889,545 | 12/1989 | Campbell et al. . |
| 5,275,005 | 1/1994 | Campbell et al. . |
| 5,555,748 | 9/1996 | Campbell et al. . |
| 5,568,737 | 10/1996 | Campbell et al. . |

FOREIGN PATENT DOCUMENTS

| | | |
|---|---|---|
| 9640604 | 12/1996 | WIPO . |

*Primary Examiner*—Ronald Capossela
*Attorney, Agent, or Firm*—Baker & Botts LLP

[57] ABSTRACT

A process for the recovery of ethane, ethylene, propane, propylene and heavier hydrocarbon components from a hydrocarbon gas stream is disclosed. The stream is divided into first and second streams, and the second stream is cooled and expanded to a lower pressure and supplied to a contacting device. The first stream is cooled to condense substantially all of it, expanded to the lower pressure, and then used to cool a warmer distillation stream from a distillation column to at least partially condense the distillation stream. At least a portion of the partially condensed distillation stream is directed to the contacting device to intimately contact the expanded second stream, the resulting vapors and liquids are separated from the contacting device, and these liquids are supplied to the distillation column. The quantities and temperatures of the feeds to the contacting device and the distillation column are effective to maintain the overhead temperatures of the contacting device and the distillation column at temperatures whereby the major portion of the desired components is recovered.

19 Claims, 6 Drawing Sheets

HYDROCARBON GAS PROCESSING

BACKGROUND OF THE INVENTION

This invention relates to a process for the separation of a gas containing hydrocarbons.

Ethylene, ethane, propylene, propane, and/or heavier hydrocarbons can be recovered from a variety of gases, such as natural gas, refinery gas, and synthetic gas streams obtained from other hydrocarbon materials such as coal, crude oil, naphtha, oil shale, tar sands, and lignite. Natural gas usually has a major proportion of methane and ethane, i.e., methane and ethane together comprise at least 50 mole percent of the gas. The gas also contains relatively lesser amounts of heavier hydrocarbons such as propane, butanes, pentanes and the like, as well as hydrogen, nitrogen, carbon dioxide and other gases.

The present invention is generally concerned with the recovery of ethylene, ethane, propylene, propane, and heavier hydrocarbons from such gas streams. A typical analysis of a gas stream to be processed in accordance with this invention would be, in approximate mole percent, 85.6% methane, 6.9% ethane and other $C_2$ components, 3.0% propane and other $C_3$ components, 0.5% iso-butane, 1.2% normal butane, 1.1% pentanes plus, with the balance made up of nitrogen and carbon dioxide. Sulfur containing gases are also sometimes present.

The historically cyclic fluctuations in the prices of both natural gas and its natural gas liquid (NGL) constituents have at times reduced the incremental value of ethane, ethylene, propane, propylene, and heavier components as liquid products. Competition for processing rights has forced plant operators to maximize the processing capacity and recovery efficiency of their existing gas processing plants, as well as to provide the ability to more quickly respond to changing market conditions. Available processes for separating these materials include those based upon cooling and refrigeration of gas, oil absorption, and refrigerated oil absorption. Additionally, cryogenic processes have become popular because of the availability of economical equipment that produces power while simultaneously expanding and extracting heat from the gas being processed. Depending upon the pressure of the gas source, the richness (ethane, ethylene, and heavier hydrocarbons content) of the gas, and the desired end products, each of these processes or a combination thereof may be employed.

The cryogenic expansion process is now generally preferred for natural gas liquids recovery because it provides maximum simplicity with ease of start up, operating flexibility, good efficiency, safety, and good reliability. U.S. Pat. Nos. 4,157,904, 4,171,964, 4,251,249, 4,278,457, 4,519,824, 4,617,039, 4,687,499, 4,689,063, 4,690,702, 4,854,955, 4,869,740, 4,889,545, 5,275,005, 5,555,748, and 5,568,737, reissue U.S. Pat. No. 33,408, co-pending application Ser. No. 08/696,114, and co-pending application Ser. No. 08/738,321 describe relevant processes (although the description of the present invention in some cases is based on different processing conditions than those described in the cited U.S. Patents).

In a typical cryogenic expansion recovery process, a feed gas stream under pressure is cooled by heat exchange with other streams of the process and/or external sources of refrigeration such as a propane compression-refrigeration system. As the gas is cooled, liquids may be condensed and collected in one or more separators as high-pressure liquids containing some of the desired $C_2$+ (or $C_3$+) components. Depending on the richness of the gas and the amount of liquids formed, the high-pressure liquids may be expanded to a lower pressure and fractionated. The vaporization occurring during expansion of the liquids results in further cooling of the stream. Under some conditions, pre-cooling the high pressure liquids prior to the expansion may be desirable in order to further lower the temperature resulting from the expansion. The expanded stream, comprising a mixture of liquid and vapor, is fractionated in a distillation (demethanizer or deethanizer) column. In the column, the expansion cooled stream(s) is (are) distilled to separate residual methane, nitrogen, and other volatile gases as overhead vapor from the desired $C_2$ components and heavier hydrocarbon components as bottom liquid product (or to separate residual methane, $C_2$ components, nitrogen, and other volatile gases as overhead vapor from the desired $C_3$ components and heavier hydrocarbon components as bottom liquid product).

If the feed gas is not totally condensed (typically it is not), the vapor remaining from the partial condensation can be split into two or more streams. One portion of the vapor is passed through a work expansion machine or engine, or an expansion valve, to a lower pressure at which additional liquids are condensed as a result of further cooling of the stream. The pressure after expansion is essentially the same as the pressure at which the distillation column is operated. The expanded stream is supplied as a feed to the column in a lower region of an absorption section contained in the distillation column and is contacted with cold liquids to absorb the $C_2$ (or $C_3$ ) components and heavier components from the vapor portion of the expanded stream.

The remaining portion of the vapor is cooled to substantial condensation by heat exchange with other process streams, e.g., the cold residue gas. Some or all of the high-pressure liquid may be combined with this vapor portion prior to cooling. The resulting cooled stream is then expanded through an appropriate expansion device, such as an expansion valve, to a pressure slightly above that at which the demethanizer (or deethanizer) column is operated. During expansion, a portion of the liquid will vaporize, resulting in cooling of the total stream. The flash expanded stream is then directed in heat exchange relation with the overhead distillation stream from the demethanizer (or deethanizer), cooling the distillation stream and condensing at least a portion of it, whereupon the warmed expanded stream is supplied to the middle or lower region of the absorption section in the distillation column. The condensed liquid in the cooled distillation stream is removed, leaving the volatile residue gas containing substantially all of the methane (or substantially all of the methane and $C_2$ components). The condensed liquid stream is then supplied to the distillation column as a top column feed so that the cold liquids contained in the stream can contact the vapor portions of the expanded stream and the warmed expanded stream in the absorption section of the distillation column.

The purpose of this process is to perform a separation that produces a residue gas leaving the process which contains substantially all of the methane in the feed gas with essentially none of the $C_2$ components and heavier hydrocarbon components (or substantially all of the methane and $C_2$ components in the feed gas with essentially none of the $C_3$ components and heavier hydrocarbon components), and a bottoms fraction leaving the demethanizer (or deethanizer) which contains substantially all of the $C_2$ components and heavier hydrocarbon components with essentially no methane or more volatile components (or substantially all of the $C_3$ components and heavier hydrocarbon components with essentially no methane, $C_2$ components or more volatile components). The present invention provides a means for modifying an existing processing plant to achieve this separation at substantially lower capital cost by eliminating much of the equipment associated with providing reflux for the absorption section of the demethanizer (or deethanizer) column. The present invention, whether applied in a new facility or as a modification to an existing processing plant, can be quickly and easily adjusted to either recover $C_2$ components in the bottom liquid product, or to reject $C_2$ components to the volatile residue gas while recovering nearly all of the $C_3$ components and heavier hydrocarbons in the bottom liquid product. This processing flexibility allows the plant operator to respond to fluctuations in natural gas and ethane prices by operating the processing plant in the manner that produces the highest product revenues.

In accordance with the present invention, it has been found that $C_2$ recoveries in excess of 86 percent can be maintained while providing essentially complete rejection of methane to the residue gas stream. In addition, it has been found that $C_3$ recoveries in excess of 97 percent can be maintained while providing essentially complete rejection of $C_2$ components to the residue gas stream. The present invention, although applicable at lower pressures and warmer temperatures, is particularly advantageous when processing feed gases at pressures in the range of 600 to 1000 psia or higher under conditions requiring column overhead temperatures of −50° F. or colder.

For a better understanding of the present invention, reference is made to the following examples and drawings. Referring to the drawings:

FIG. 1 is a flow diagram of a prior art cryogenic natural gas processing plant;

FIG. 2 is a flow diagram illustrating how the processing plant of FIG. 1 can be adapted to be a cryogenic expansion natural gas processing plant of the prior art according to U.S. Pat. No. 4,854,955;

In the following explanation of the above figures, tables are provided summarizing flow rates calculated for representative process conditions. In the tables appearing herein, the values for flow rates (in pound moles per hour) have been rounded to the nearest whole number for convenience. The total stream rates shown in the tables include all nonhydrocarbon components and hence are generally larger than the sum of the stream flow rates for the hydrocarbon components. Temperatures indicated are approximate values rounded to the nearest degree. It should also be noted that the process design calculations performed for the purpose of comparing the processes depicted in the figures are based on the assumption of no heat leak from (or to) the surroundings to (or from) the process. The quality of commercially available insulating materials makes this a very reasonable assumption and one that is typically made by those skilled in the art.

DESCRIPTION OF THE PRIOR ART

Figure 1:
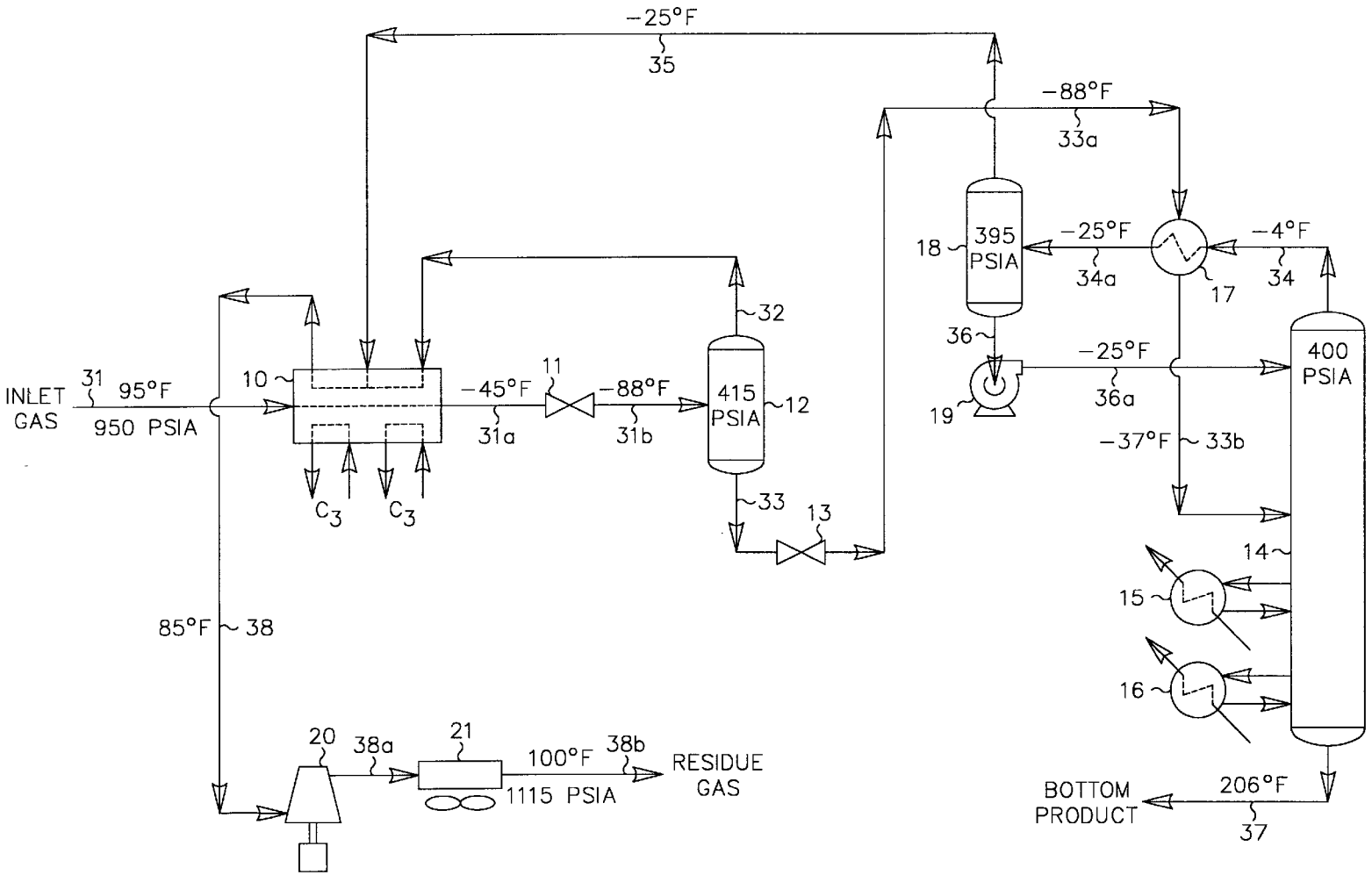
FIG. 1 (PRIOR ART)

FIG. 1 is a flow diagram showing the original design of an existing processing plant using prior art to recover $C_3$+ components from natural gas. As originally designed, inlet gas enters the plant at 95° F. and 950 psia as stream 31. Had the inlet gas contained a concentration of sulfur compounds which would prevent the product streams from meeting specifications, the sulfur compounds would have been removed by appropriate pretreatment of the feed gas (not illustrated). In addition, the feed stream is dehydrated to prevent hydrate (ice) formation under cryogenic conditions (also not illustrated). Solid desiccant is used for this purpose in the existing facility.

The feed stream 31 is cooled to −45° F. in exchanger 10 by heat exchange with cool reflux separator vapor at −25° F. (stream 35), with cold separator vapor at −88° F. (stream 32), and with external propane refrigerant. (The decision as to whether to use more than one heat exchanger for the indicated cooling services will depend on a number of factors including, but not limited to, feed gas flow rate, heat exchanger size, stream temperatures, etc.)

The cooled and partially condensed stream 31*a* is flash expanded in expansion valve 11 to 415 psia, slightly above the operating pressure of deethanizer column 14. During expansion a part of the condensed liquid is vaporized, cooling the expanded stream 31*b* to −88° F. before it enters separator 12, whereupon the vapor (stream 32) is separated from the condensed liquid (stream 33). The liquid (stream 33) from separator 12 is directed by level control valve 13 to heat exchanger 17 and is heated to −37° F. by heat exchange with the overhead distillation stream 34 from deethanizer 14, whereupon heated stream 33*b* enters deethanizer 14 at a mid-column feed point to be stripped of its methane and $C_2$ components.

The deethanizer tower 14, operating at 400 psia, is a conventional distillation column containing a plurality of vertically spaced trays, one or more packed beds, or some combination of trays and packing. The deethanizer tower may consist of two sections: an upper section wherein any vapor contained in the top feed is separated from its corresponding liquid portion, and wherein the vapor rising from the lower distillation or deethanizing section is combined with the vapor portion (if any) of the top feed to form distillation stream 34 which exits the top of the tower; and a lower deethanizing section that contains the trays and/or packing to provide the necessary contact between the liquids falling downward and the vapors rising upward. The deethanizing section also includes side reboiler 15 and reboiler 16 which heat and vaporize a portion of the liquid in the lower regions of the column to provide the stripping vapors which flow up the column to strip the liquid product, stream 37, of methane and $C_2$ components. A typical specification for the bottom liquid product is to have an ethane to propane+ butane ratio of 0.02:1 on a molar basis. The liquid product stream 37 exits the bottom of the deethanizer at 206° F. and flows to subsequent processing and/or storage.

The deethanizer overhead vapor (stream 34) at −4° F. flows through heat exchanger 17 and is cooled to −25° F. in heat exchange relation with the expanded separator liquids (stream 33*a*), partially condensing stream 34*a*. The partially condensed stream 34*a* enters reflux separator 18 where its condensed liquid is separated from the uncondensed vapor (stream 35) and becomes the liquid reflux stream 36, which is returned to deethanizer 14 by reflux pump 19. The reflux stream (stream 36*a*) enters column 14 at a top column feed point and contacts the vapors rising upward through the deethanizing section.

The vapor (stream 32) leaving separator 12 at −88° F. passes countercurrently to incoming feed gas (stream 31) in heat exchanger 10 and is partially warmed as it provides cooling and partial condensation of the feed gas. The partially warmed separator vapor is then combined with the reflux separator vapor (stream 35) to form the residue gas, which is further warmed to 85° F. (stream 38) as it also passes countercurrently to the incoming feed gas in heat exchanger 10. The residue gas is then re-compressed in one stage by compressor 20 driven by a supplemental power source which compresses the residue gas (stream 38*a*) to sales line pressure. After cooling in discharge cooler 21, the residue gas product (stream 38*b*) flows to the sales gas pipeline at 100° F. and 1115 psia.

A summary of stream flow rates and energy consumptions for the process illustrated in FIG. 1 is set forth in the following table:

TABLE I (FIG. 1)
Stream Flow Summary - (Lb. Moles/Hr)

| Stream | Methane | Ethane | Propane | Butanes+ | Total |
|---|---|---|---|---|---|
| 31 | 12608 | 2297 | 951 | 588 | 16469 |
| 32 | 10195 | 601 | 52 | 5 | 10867 |
| 33 | 2413 | 1696 | 899 | 583 | 5602 |
| 35 | 2413 | 1693 | 6 | 0 | 4123 |
| 38 | 12608 | 2294 | 58 | 5 | 14990 |
| 37 | 0 | 3 | 893 | 583 | 1479 |
| | Recoveries* | | | | |
| | Propane | | | 93.88% | |
| | Butanes+ | | | 99.15% | |
| | Horsepower | | | | |
| | Residue Compression | | | 9,917 | |
| | Refrigeration Compression | | | 6,480 | |
| | Total | | | 16,397 | |
| | Utility Heat, MBTU/Hr | | | | |
| | Deethanizer Reboilers | | | 29,591 | |

*(Based on un-rounded flow rates)

Figure 2:
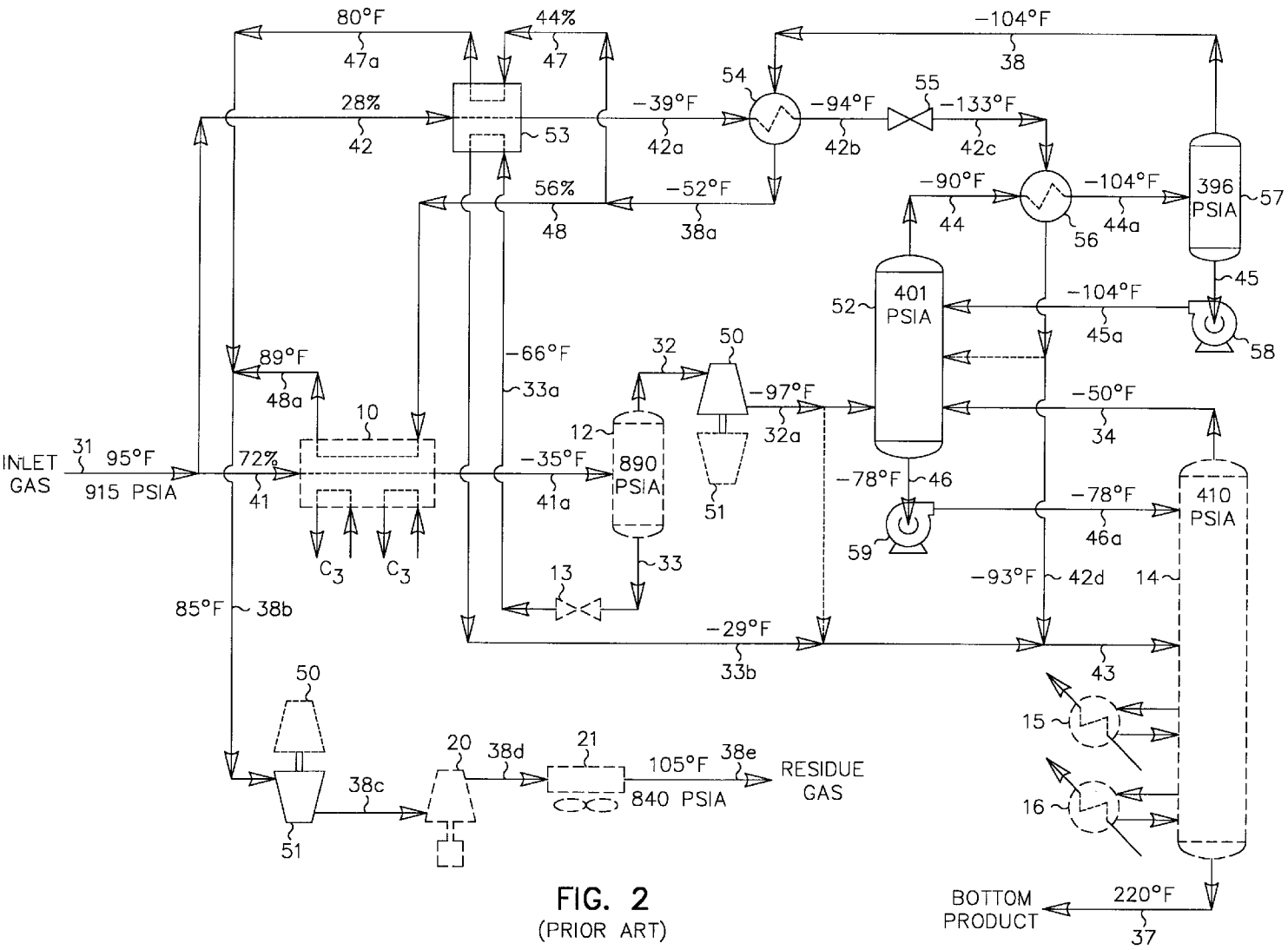
FIG. 2 (PRIOR ART)

The plant operator of the existing processing plant depicted in FIG. 1 subsequently needed to process additional volumes of natural gas, in excess of the feed gas rate for which the plant was originally designed, at somewhat different processing conditions. FIG. 2 represents how the processing plant of FIG. 1 could be modified to increase capacity by applying a prior art process in accordance with U.S. Pat. No. 4,854,955. For clarity, the existing plant equipment in the FIG. 1 process that could be reused in the modified FIG. 2 process arrangement is shown with dashed lines and the new equipment required is shown with solid lines. Due to changes in the natural gas supply to the existing plant, the feed gas composition and conditions considered in the process presented in FIG. 2 are not the same as those in FIG. 1. As a result, the component recovery levels and utility consumptions for the FIG. 1 process and the FIG. 2 process are not directly comparable.

In the simulation of the FIG. 2 process, feed gas enters at 95° F. and a pressure of 915 psia as stream 31 and is split into two portions, stream 41 and stream 42. About 72 percent of feed stream 31 (stream 41) is routed to the existing plant equipment and cooled in exchanger 10 by heat exchange with a portion of the cool residue gas at −52° F. (stream 48) and with external propane refrigerant. The cooled stream 41*a* enters separator 12 at −35° F. and 890 psia where the vapor (stream 32) is separated from the condensed liquid (stream 33). The condensed liquid is flash expanded to slightly above the operating pressure of deethanizer 14 in expansion valve 13. As the stream is expanded, a portion of the liquid vaporizes, cooling the total stream 33*a* to a temperature of approximately −66° F. The expanded stream is then directed in heat exchange relation with the other portion (stream 42) of the feed gas in heat exchanger 53 and heated to −29° F. (stream 33*b*).

The vapor from separator 12 (stream 32) enters a work expansion machine 50 in which mechanical energy is extracted from this portion of the high pressure feed. The machine 50 expands the vapor substantially isentropically from a pressure of about 890 psia to a pressure of about 403 psia, with the work expansion cooling the expanded stream 32*a* to a temperature of approximately −97° F. The typical commercially available expanders are capable of recovering on the order of 80–85% of the work theoretically available in an ideal isentropic expansion. The work recovered is often used to drive a centrifugal compressor (such as item 51), that can be used to re-compress the residue gas (stream 38*b*), for example. The expanded and partially condensed stream 32*a* is supplied as feed to an absorbing section in a lower region of separator/absorber tower 52. The liquid portion of the expanded stream commingles with liquids falling downward from the absorbing section and the combined liquid stream 46 exits the bottom of separator/absorber 52. The vapor portion of the expanded stream rises upward through the absorbing section and is contacted with cold liquid falling downward. Note that stream 32*a* could alternatively be supplied to deethanizer 14 as indicated by the dashed line, but this would increase the amount of vapor traffic in the top fractionation stages. The existing fractionation trays in deethanizer 14 could not handle this additional vapor load, hence in the current application stream 32*a* is supplied to separator/absorber 52. The optimum feed location for this and all other feed streams in a particular circumstance will often depend on a number of factors such as existing equipment limitations (as seen in this case), as well as feed gas composition and conditions, plant size, etc.

The separator/absorber tower 52 is a conventional distillation column containing a plurality of vertically spaced trays, one or more packed beds, or some combination of trays and packing. As is often the case in natural gas processing plants, the separator/absorber tower may consist of two sections. The upper section is a separator wherein any vapor contained in the top feed is separated from its corresponding liquid portion, and wherein the vapor rising from the lower distillation or absorbing section is combined with the vapor portion (if any) of the top feed to form the distillation stream 44 which exits the top of the tower. The lower, absorbing section contains the trays and/or packing and provides the necessary contact between the liquids falling downward and the vapors rising upward to condense and absorb the propane and heavier components. The combined liquid stream 46 leaves the bottom of separator/absorber 52 at −78° F. It is supplied (stream 46*a*) to deethanizer 14 by pump 59 at a top column feed position.

Returning to the second portion (stream 42) of the feed gas, the remaining 28 percent of the feed gas enters heat exchanger 53 where it is cooled to −39° F. and partially condensed by heat exchange with the other portion of the cool residue gas at −52° F. (stream 47) and with the flash expanded separator liquid at −66° F. (stream 33*a*). The cooled stream 42*a* then enters heat exchanger 54 and is further cooled and substantially condensed by heat exchange with the cold residue gas at −104° F. (stream 38). The substantially condensed stream 42*b* at −94° F. is then flash expanded through an appropriate expansion device, such as expansion valve 55, to slightly above the operating pressure of the fractionation tower 14. During expansion a portion of the stream is vaporized, resulting in cooling of the total stream. In the process illustrated in FIG. 2, the expanded stream 42*c* leaving expansion valve 55 reaches a temperature of −133° F. and is supplied to heat exchanger 56. This stream is warmed and further vaporized in heat exchanger 56 as it provides cooling and partial condensation of the distillation stream 44 rising from the fractionation stages of separator/absorber 52. The warmed stream 42*d* at a temperature of −93° F. is then supplied together with the heated expanded stream 33*b* to deethanizer column 14 at a mid-column feed position as stream 43. Note that stream 42*d* could alternatively be supplied to separator/absorber 52 at a mid-column or bottom feed position as indicated by the dashed line, but this would have increased the quantity of liquid fed to the top stages of deethanizer 14 by pump 59. Without costly modifications and extended plant downtime, the existing fractionation trays in deethanizer 14 could not handle this additional liquid load, hence in the current application stream 42*d* is supplied to tower 14 at a point below the top stages. Again, the optimum feed location for this feed stream in a particular circumstance will often depend on a number of factors such as existing equipment limitations (as seen in this case), as well as feed gas composition and conditions, plant size, etc.

Distillation stream 44 from separator/absorber 52 is cooled from a temperature of −90° F. to approximately −104° F. (stream 44*a*) by heat exchange with stream 42*c*. The partially condensed stream 44*a* is supplied to reflux separator 57 operating at about 396 psia. The condensed liquid (stream 45) is separated, and returned to separator/absorber 52 as reflux stream 45*a* at a top column feed position by means of reflux pump 58. The vapor stream 38 from reflux separator 57 is the cold volatile residue gas stream. (It should be noted that the existing reflux separator and reflux pump, items 18 and 19, respectively, in FIG. 1 could not be reused in the FIG. 2 process as items 57 and 58, respectively, because the much lower operating temperature for these equipment items in the FIG. 2 process would not be compatible with the metallurgy of items 18 and 19.)

Deethanizer 14 operates at a pressure of approximately 410 psia. It should be noted that the majority of the plant feed gas is not supplied to this tower but is instead fed to separator/absorber 52, reducing the vapor traffic in tower 14 and allowing the desired increase in plant processing capacity. The liquid product stream 37 exits the bottom of the deethanizer at 220° F. and flows to subsequent processing and/or storage. The overhead vapor distillation stream 34 at −50° F. from the upper region of deethanizer 14 is supplied to separator/absorber 52 at a lower feed point so that the vapor is contacted with cold liquid falling downward to condense and absorb the propane and heavier components.

The cold residue gas stream 38 from reflux separator 57 passes countercurrently to a portion (stream 42*d*) of the feed gas in heat exchanger 54 where it is warmed to −52° F. (stream 38*a*) as it provides further cooling and substantial condensation of stream 42*b*. The cool residue gas stream 38*a* is then divided into two portions, streams 47 and 48. Streams 47 and 48 pass countercurrently to the feed gas in heat exchangers 53 and 10, respectively, and are warmed to 80° F. and 89° F. (streams 47*a* and 48*a*, respectively) as the streams provide cooling and partial condensation of the feed gas. The two warmed streams 47*a* and 48*a* then recombine as residue gas stream 38*b* at a temperature of 85° F. This recombined stream is then re-compressed in two stages. The first stage is compressor 51 driven by expansion machine 50. The second stage is compressor 20 driven by a supplemental power source. The compressed stream 38*d* is then cooled to 105° F. by heat exchanger 21 before the residue gas product (stream 38*e*) flows to the sales gas pipeline at the new line pressure of 840 psia.

A summary of stream flow rates and energy consumptions for the process illustrated in FIG. 2 is set forth in the table below:

TABLE II (FIG. 2)
Stream Flow Summary - (Lb. Moles/Hr)

| Stream | Methane | Ethane | Propane | Butanes+ | Total |
|---|---|---|---|---|---|
| 31 | 17898 | 1441 | 636 | 594 | 20913 |
| 41 | 12797 | 1030 | 455 | 425 | 14953 |
| 42 | 5101 | 411 | 181 | 169 | 5960 |
| 32 | 11880 | 756 | 216 | 80 | 13168 |
| 33 | 917 | 274 | 239 | 345 | 1785 |
| 34 | 6769 | 1469 | 116 | 7 | 8480 |
| 44 | 18937 | 2315 | 7 | 0 | 21619 |
| 45 | 1039 | 895 | 6 | 0 | 1954 |
| 46 | 751 | 805 | 331 | 87 | 1983 |
| 38 | 17898 | 1420 | 1 | 0 | 19665 |
| 37 | 0 | 21 | 635 | 594 | 1248 |

| | |
|---|---|
| Recoveries* | |
| Propane | 99.76% |
| Butanes+ | 100.00% |
| Horsepower | |
| Residue Compression | 9,705 |
| Refrigeration Compression | 2,939 |
| Total | 12,644 |
| Utility Heat, MBTU/Hr | |
| Deethanizer Reboilers | 23,276 |

*(Based on un-rounded flow rates)

Comparison of the feed gas flow rates and utility consumptions in Table II above for the FIG. 2 process with those in Table I for the FIG. 1 process shows that the FIG. 2 process achieves a 27 percent increase in gas processing capacity while improving propane recovery and butanes+ recovery. Comparison of Tables I and II further shows that the improvement in throughput and yields was not simply the result of increasing the horsepower (utility) requirements. To the contrary, the residue compression horsepower for the FIG. 2 process is 2 percent lower than the FIG. 1 process (allowing reuse of the existing residue compressors without modification) and the refrigeration compression for the FIG. 2 process is less than half of the FIG. 1 process (allowing an existing refrigeration compressor to be used elsewhere).

DESCRIPTION OF THE INVENTION

EXAMPLE 1

Figure 3:
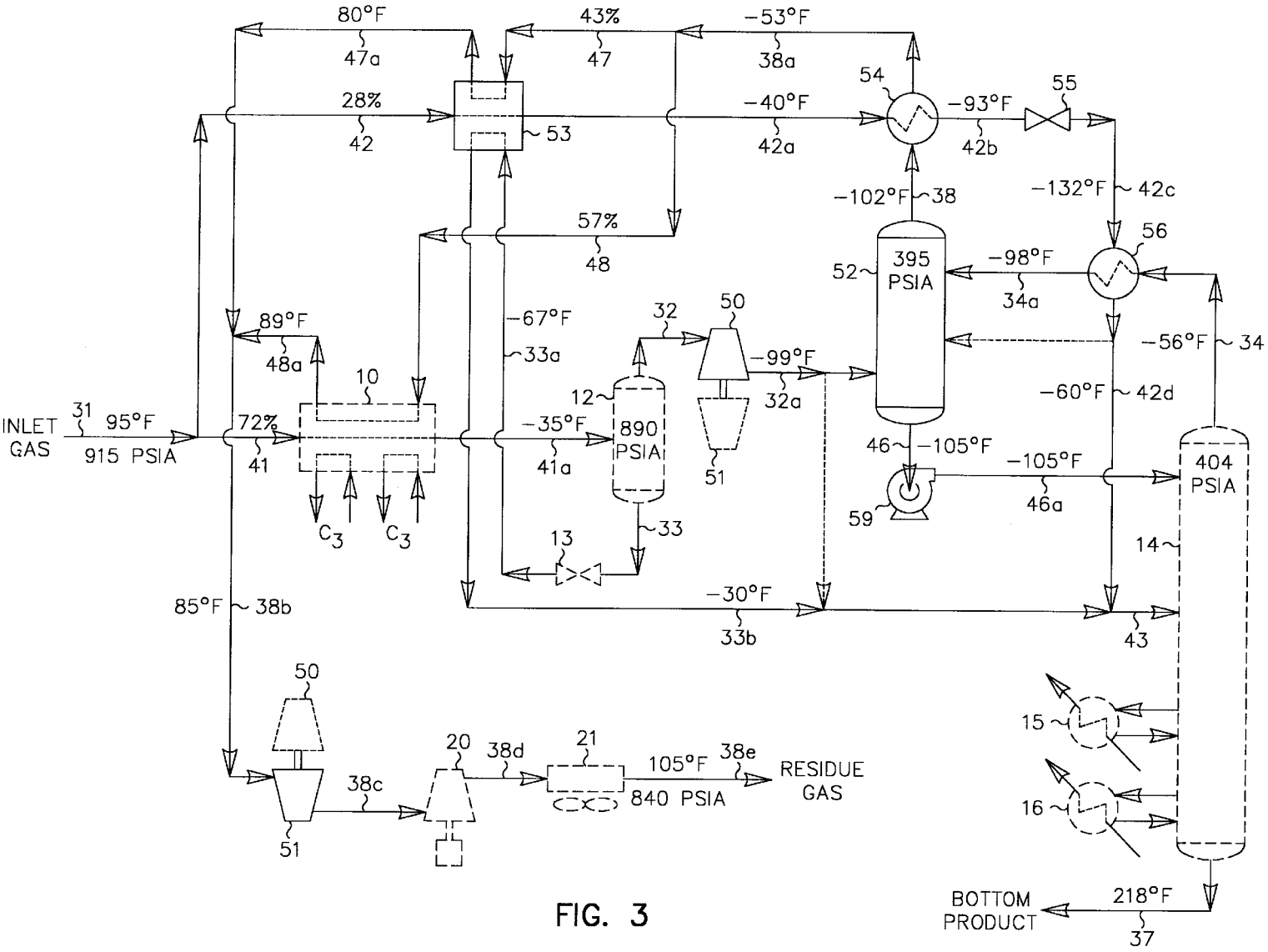
FIG. 3 is a flow diagram illustrating how the processing plant of FIG. 1 can be adapted to be a natural gas processing plant in accordance with the present invention.

FIG. 3 illustrates how the processing plant of FIG. 1 can be modified in accordance with the present invention. The feed gas composition and conditions considered in the process presented in FIG. 3 are the same as those in FIG. 2. Accordingly, the FIG. 3 process can be compared with that of the FIG. 2 process to illustrate the advantages of the present invention. In the simulation of this process, as in the simulation for the process of FIG. 2, operating conditions were selected to maximize recovery level for a given energy consumption. For clarity, the existing plant equipment in the FIG. 1 process that can be reused in the modified FIG. 3 process arrangement is shown with dashed lines and the new equipment required is shown with solid lines.

The feed gas splitting, cooling, partial condensation, and separation scheme is essentially the same as that used in FIG. 2. The difference lies in the manner in which the substantially condensed and flash expanded stream 42*c* is used to 30 generate reflux for the separator/absorber 52. During flash expansion in expansion valve 55, a portion of the liquid in stream 42*b* vaporizes, cooling the total stream to −132° F. (stream 42*c*). The expanded stream 42*c* is then supplied to heat exchanger 56 where it is warmed and further vaporized as it provides cooling and partial condensation of the distillation stream 34 rising from the upper region of deethanizer 14. The warmed stream 42*d* at a temperature of −60° F. is then supplied together with the heated expanded stream 33*b* to deethanizer column 14 at a mid-column feed position as stream 43. (As noted previously for the FIG. 2 process, stream 42*d* could alternatively be supplied to separator/absorber 52 at a mid-column or bottom feed position as indicated by the dashed line, but this would have increased the quantity of liquid fed to the top stages of deethanizer 14 by pump 59. For this particular case, stream 42*d* is supplied to tower 14 at a point below the top stages to reduce the load on the fractionation trays in the upper section of the tower.)

Distillation stream 34 is cooled from a temperature of −56° F. to approximately −98° F. (stream 34*a*) by heat exchange with stream 42*c*. The partially condensed stream 34*a* is then supplied to the separator section in separator/absorber tower 52 where the condensed liquid is separated from the uncondensed vapor. The uncondensed vapor combines with the vapor rising from the lower absorbing section to form the cold distillation stream 38 leaving the upper region of separator/absorber 52 at a temperature of −102° F. The condensed liquid portion of stream 34*a* becomes the cold liquid (reflux) falling downward which contacts the vapor portion of the expanded stream 32*a* rising upward through the absorbing section of separator/absorber 52, condensing and absorbing the propane and heavier components contained in the vapor.

Deethanizer 14 operates at a pressure of approximately 404 psia. As noted earlier for the FIG. 2 process, the majority of the plant feed gas is not supplied to this tower but is instead fed to separator/absorber 52, reducing the vapor traffic in tower 14 and allowing the desired increase in plant processing capacity. The liquid product stream 37 exits the bottom of the deethanizer at 218° F. and flows to subsequent processing and/or storage. The overhead vapor distillation stream 34 at −56° F. from the upper region of deethanizer 14 is partially condensed and supplied to separator/absorber 52 at a top feed position as described earlier.

The distillation stream leaving the upper region of separator/absorber 52 is the cold residue gas stream 38 at −102° F., which passes countercurrently to a portion (stream 42*a*) of the feed gas in heat exchanger 54 where it is warmed to −53° F. (stream 38*a*) as it provides further cooling and substantial condensation of stream 42*b*. The cool residue gas stream 38*a* is then divided into two portions, streams 47 and 48. Streams 47 and 48 pass countercurrently to the feed gas in heat exchangers 53 and 10, respectively, and are warmed to 80° F. and 89° F. (streams 47*a* and 48*a*, respectively) as the streams provide cooling and partial condensation of the feed gas. The two warmed streams 47*a* and 48*a* then recombine as residue gas stream 38*b* at a temperature of 85° F. This recombined stream is then re-compressed in two stages. The first stage is compressor 51 driven by expansion machine 50. The second stage is compressor 20 driven by a supplemental power source. The compressed stream 38*d* is then cooled to 105° F. by heat exchanger 21 before the residue gas product (stream 38*e*) flows to the sales gas pipeline at the new line pressure of 840 psia.

A summary of stream flow rates and energy consumptions for the process illustrated in FIG. 3 is set forth in the table below:

TABLE III (FIG. 3)
Stream Flow Summary - (Lb. Moles/Hr)

| Stream | Methane | Ethane | Propane | Butanes+ | Total |
|---|---|---|---|---|---|
| 31 | 17898 | 1441 | 636 | 594 | 20913 |
| 41 | 12886 | 1037 | 458 | 428 | 15058 |
| 42 | 5012 | 404 | 178 | 166 | 5855 |
| 32 | 11957 | 760 | 217 | 80 | 13252 |
| 33 | 929 | 277 | 241 | 348 | 1806 |
| 34 | 7555 | 1750 | 70 | 5 | 9507 |
| 46 | 1614 | 1089 | 273 | 85 | 3081 |
| 38 | 17898 | 1421 | 14 | 0 | 19678 |
| 37 | 0 | 20 | 622 | 594 | 1235 |

| | |
|---|---|
| Recoveries* | |
| Propane | 97.83% |
| Butanes+ | 99.96% |
| Horsepower | |
| Residue Compression | 9,705 |
| Refrigeration Compression | 2,947 |
| Total | 12,652 |
| Utility Heat, MBTU/Hr | |
| Deethanizer Reboilers | 23,352 |

*(Based on un-rounded flow rates)

Comparison of the feed gas flow rates and utility consumptions in Table III above for the FIG. 3 process with those in Table I for the FIG. 1 process shows that the FIG. 3 process also achieves a 27 percent increase in gas processing capacity while improving propane recovery and butanes+ recovery. Comparison of Tables I and III further shows that the improvement in throughput and yields was not simply the result of increasing the horsepower (utility) requirements. To the contrary, the residue compression horsepower for the FIG. 3 process is 2 percent lower than the FIG. 1 process (allowing reuse of the existing residue compressors without modification) and the refrigeration compression for the FIG. 3 process is less than half of the FIG. 1 process (allowing an existing refrigeration compressor to be used elsewhere).

Comparing the present invention to the prior art process displayed in FIG. 2, Tables II and III show that the present invention process very nearly matches the recovery efficiency of the FIG. 2 prior art process for $C_3$+ components. However, unlike the FIG. 2 process when it is adapted to an existing processing facility, the present invention does not require a reflux separator and reflux pump to provide the reflux stream for the separator/absorber, substantially reducing the capital cost for modifying the FIG. 1 process to achieve higher processing capacity and higher $C_3$+ product recovery levels.

The FIG. 3 process creates an absorption cooling effect inside separator/absorber 52 similar to that described in U.S. Pat. No. 4,617,039, wherein the saturation of the vapors rising upward through the tower by vaporization of liquid methane and ethane contained in the condensed liquid portion of stream 34*a* provides refrigeration to the tower. Note that, as a result, both the vapor leaving the overhead of the tower and the liquids leaving the bottom of the tower are colder than the respective feed streams at those ends of the tower. This absorption cooling effect allows the tower bottoms (stream 46) to be colder, creating a more effective reflux stream (stream 46*a*) for the deethanizer. Comparing the deethanizer overhead stream (stream 34 in FIGS. 2 and 3) in Tables II and III shows that the $C_3$+ concentration of the tower overhead in the FIG. 3 process is only half as much as that in the FIG. 2 process as a result of this absorption cooling effect.

EXAMPLE 2

Figure 4:
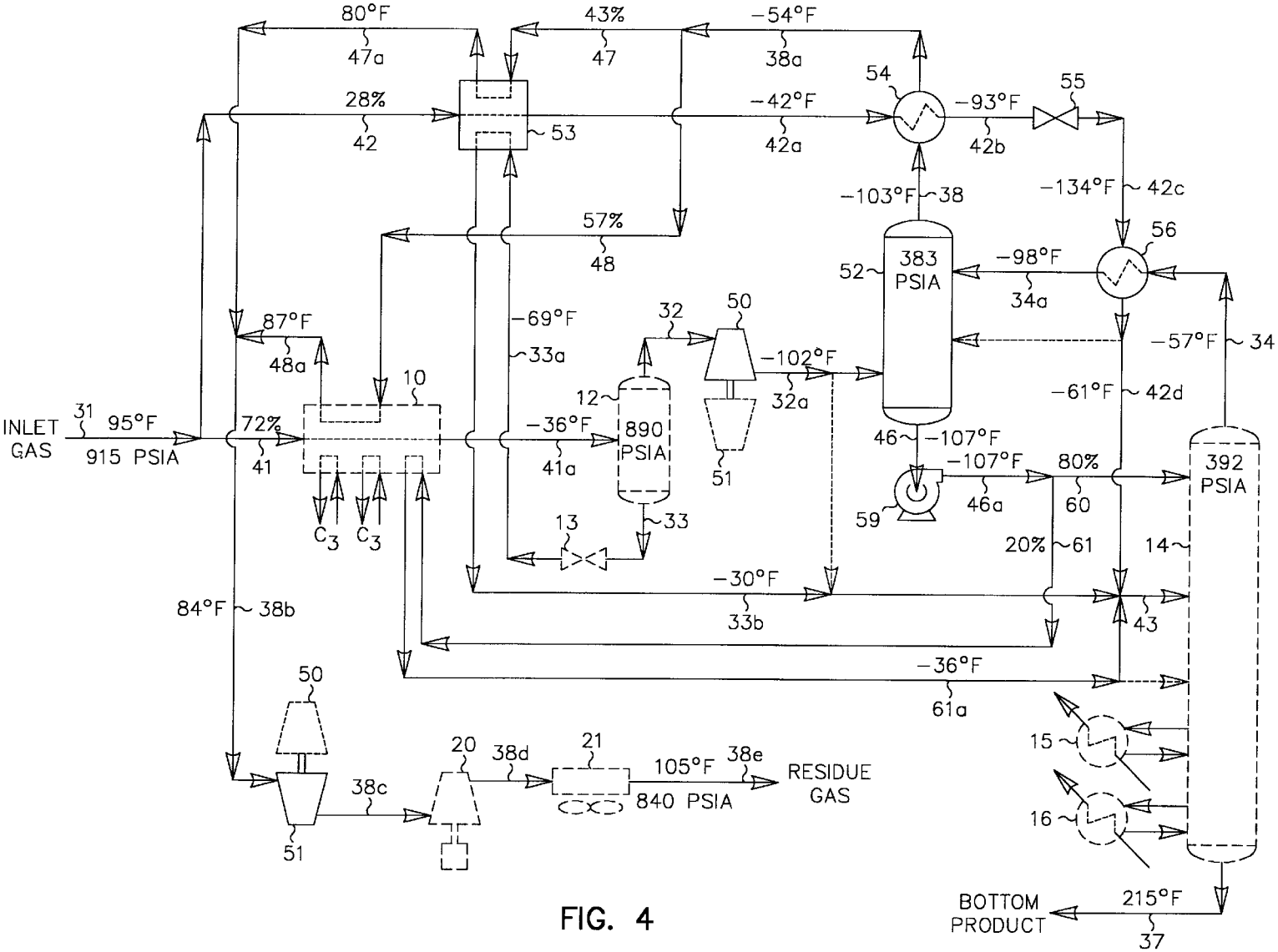
FIG. 4 is a flow diagram illustrating an alternative means of adapting the processing plant of FIG. 1 to be a natural gas processing plant in accordance with the present invention.

FIG. 4 illustrates how the processing plant of FIG. 1 can be modified in accordance with an alternative embodiment of the present invention. The feed gas composition and conditions considered in the process presented in FIG. 4 are the same as those in FIG. 3. For clarity, the existing plant equipment in the FIG. 1 process that can be reused in the modified FIG. 4 process arrangement is shown with dashed lines and the new equipment required is shown with solid lines.

The feed gas splitting, cooling, partial condensation, and separation scheme is similar to that used in FIG. 3. The main difference is that a portion of the liquid stream from the bottom of separator/absorber 52 is used for feed gas cooling, allowing greater cooling of the feed gas while reducing the heat exchange required from gas stream 48. In the simulation of the FIG. 4 process, feed gas enters at 95° F. and a pressure of 915 psia as stream 31 and is split into two portions, stream 41 and stream 42. About 72 percent of feed stream 31 (stream 41) is routed to the existing plant equipment and cooled in exchanger 10 by heat exchange with a portion of the cool residue gas at −54° F. (stream 48), with external propane refrigerant, and with a portion of the liquid stream from the bottom of separator/absorber 52 at −107° F. (stream 61). The cooled stream 41*a* enters separator 12 at −36° F. and 890 psia where the vapor (stream 32) is separated from the condensed liquid (stream 33) and is then work expanded and supplied to separator/absorber 52 as described previously. The condensed liquid is flash expanded and used for heat exchange as described previously.

Liquid stream 46 leaves the bottom of separator/absorber 52 at −107° F. and enters pump 59. Stream 46*a* from pump 59 is then split into two portions, stream 60 and stream 61. About 80% of stream 46*a* (stream 60) is directed to deethanizer 14 at a top column feed position as described previously. The remaining portion (stream 61) is directed to heat exchanger 10 where it provides cooling to the feed gas as described previously as it is heated to −36° F. and partially vaporized. The warmed stream 61*a* at a temperature of −36° F. is then supplied together with the warmed stream 42*d* and the heated expanded stream 33*b* to deethanizer column 14 at a mid-column feed position as stream 43. (For the FIGS. 3 and 4 processes, all or a part of stream 42*d* could alternatively be supplied to separator/absorber 52 at a mid-column or bottom feed position as indicated by the dashed line, but this increases the quantity of liquid fed to the top stages of deethanizer 14 by pump 59. For this particular case, stream 42*d* is supplied to tower 14 at a point below the top stages to reduce the load on the fractionation trays in the upper section of the tower. Also, all or a part of stream 61*a* could alternatively be supplied separately to deethanizer 14 at a lower mid-column feed position as shown by the dashed line, but this requires adding another feed tray to existing deethanizer 14. For this particular case, combining stream 61*a* with the other two streams was deemed to be the more economical alternative.)

The other features of the process of FIG. 4 are substantially the same as the process of FIG. 3 described previously. A summary of stream flow rates and energy consumptions for the process illustrated in FIG. 4 is set forth in the table below:

TABLE IV (FIG. 4)
Stream Flow Summary - (Lb. Moles/Hr)

| Stream | Methane | Ethane | Propane | Butanes+ | Total |
|---|---|---|---|---|---|
| 31 | 17898 | 1441 | 636 | 594 | 20913 |
| 41 | 12886 | 1037 | 458 | 428 | 15058 |
| 42 | 5012 | 404 | 178 | 166 | 5855 |
| 32 | 11928 | 753 | 213 | 78 | 13210 |
| 33 | 958 | 284 | 245 | 350 | 1848 |
| 34 | 7633 | 1791 | 68 | 4 | 9624 |
| 46 | 1663 | 1123 | 268 | 82 | 3157 |
| 38 | 17898 | 1421 | 13 | 0 | 19677 |
| 37 | 0 | 20 | 623 | 594 | 1236 |

| | |
|---|---|
| Recoveries* | |
| Propane | 97.99% |
| Butanes+ | 99.97% |
| Horsepower | |
| Residue Compression | 9,709 |
| Refrigeration Compression | 2,944 |
| Total | 12,653 |
| Utility Heat, MBTU/Hr | |
| Deethanizer Reboilers | 21,919 |

*(Based on un-rounded flow rates)

As before for the FIG. 3 process, the alternative embodiment of the present invention as applied in FIG. 4 can achieve a 27 percent increase in gas processing capacity. Comparison of the utility consumptions of the FIG. 3 embodiment of the present invention displayed in Table III with the utility consumptions of the FIG. 4 embodiment of the present invention displayed in Table IV shows that the better heat integration possible with the FIG. 4 embodiment reduces the utility heat requirement by more than 5 percent while improving the propane recovery from 97.83% to 97.99%. The choice of whether to use the slightly more complicated FIG. 4 embodiment of the present invention will usually be based on economics, and will be influenced by such factors as plant size and available equipment, relative values of products and utility heat, and the composition of the feed gas.

EXAMPLE 3

Figure 5:
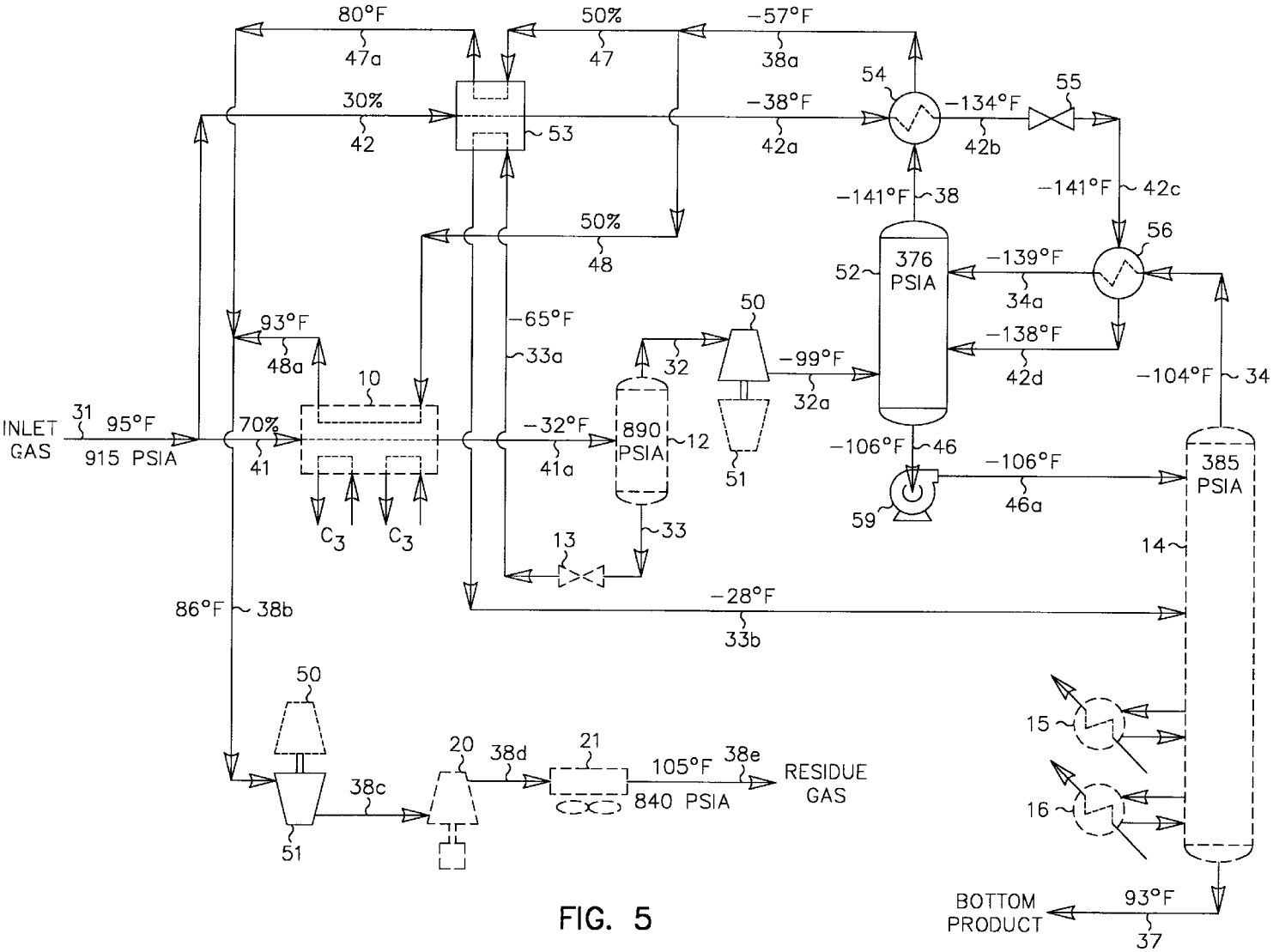
FIG. 5 is a flow diagram illustrating an alternative means of adapting the processing plant of FIG. 1 to be a natural gas processing plant in accordance with the present invention.

FIG. 3 represents the preferred embodiment of the present invention for the temperature and pressure conditions shown when modifying an existing processing plant for recovery of $C_3$+ components in the liquid product while rejecting $C_2$ components and more volatile components to the residue gas is desired. FIG. 5 represents an alternative embodiment of the present invention when modification of an existing processing plant for recovery of a significant amount of the $C_2$ components in the liquid product is desired. The feed gas composition and conditions considered in the process presented in FIG. 5 are the same as those in FIG. 3. For clarity, the existing plant equipment in the FIG. 1 process that can be reused in the modified FIG. 5 process arrangement is shown with dashed lines and the new equipment required is shown with solid lines.

In the simulation of the FIG. 5 process, feed gas enters at 95° F. and a pressure of 915 psia as stream 31 and is split into two portions, stream 41 and stream 42. About 70 percent of feed stream 31 (stream 41) is routed to the existing plant equipment and cooled in exchanger 10 by heat exchange with a portion of the cool residue gas at −57° F. (stream 48) and with external propane refrigerant. The cooled stream 41*a* enters separator 12 at −32° F. and 890 psia where the vapor (stream 32) is separated from the condensed liquid (stream 33). The condensed liquid is flash expanded to slightly above the operating pressure of demethanizer 14 in expansion valve 13. As the stream is expanded, a portion of the liquid vaporizes, cooling the total stream 33*a* to a temperature of approximately −65° F. The expanded stream is then directed in heat exchange relation with the other portion (stream 42) of the feed gas in heat exchanger 53 and heated to −28° F. (stream 33*b*), and thereafter supplied to demethanizer 14 at a mid-column feed position.

The vapor from separator 12 (stream 32) enters a work expansion machine 50 in which mechanical energy is extracted from this portion of the high pressure feed. The machine 50 expands the vapor substantially isentropically from a pressure of about 890 psia to a pressure of about 378 psia, with the work expansion cooling the expanded stream 32*a* to a temperature of approximately −99° F. The expanded and partially condensed stream 32*a* is supplied as feed to an absorbing section in a lower region of separator/absorber tower 52. The liquid portion of the expanded stream commingles with liquids falling downward from the absorbing section and the combined liquid stream 46 exits the bottom of separator/absorber 52 at −106° F. and is supplied (stream 46*a*) to demethanizer 14 by pump 59 at a top column feed position. The vapor portion of the expanded stream rises upward through the absorbing section and is contacted with cold liquid falling downward.

Returning to the second portion (stream 42) of the feed gas, the remaining 30 percent of the feed gas enters heat exchanger 53 where it is cooled and partially condensed by heat exchange with the other portion of the cool residue gas at −57° F. (stream 47) and with the flash expanded separator liquid at −65° F. (stream 33*a*). The cooled stream 42*a* at −38° F. then enters heat exchanger 54 and is further cooled and substantially condensed by heat exchange with the cold residue gas (stream 38) at −141° F. The substantially condensed stream 42*b* at −134° F. is then flash expanded through an appropriate expansion device, such as expansion valve 55, to slightly above the operating pressure of the separator/absorber 52. During expansion a portion of the stream is vaporized, resulting in cooling of the total stream. In the process illustrated in FIG. 5, the expanded stream 42*c* leaving expansion valve 55 reaches a temperature of −141° F. and is supplied to heat exchanger 56 where it is warmed and partially vaporized as it provides cooling and partial condensation of the distillation stream 34 rising from the upper region of demethanizer 14. The warmed stream 42*d* at a temperature of −138° F. is then supplied to separator/absorber 52 at a mid-column feed position.

It should be noted that when the process of FIG. 5 is operated to recover $C_2$ components in the bottom product of tower 14 (rather than to reject $C_2$ components to the residue gas as in the FIG. 3 process), less reboiler heat is required to meet the bottom product specification for tower 14. The resulting decrease in vapor and liquid traffic in the fractionation stages reduces the load on the top stages of tower 14, so that in this example it is possible to supply the warmed expanded stream 42*d* to separator/absorber 52 at the optimum mid-column feed position without overloading the top fractionation stages in tower 14 with the liquids (stream 46*a*) supplied to tower 14 from the bottom of separator/absorber 52.

Distillation stream 34 is cooled to a temperature of approximately −139° F. (stream 34*a*) by heat exchange with stream 42*c*. The partially condensed stream 34*a* is then supplied to the separator section in separator/absorber tower 52 where the condensed liquid is separated from the uncondensed vapor. The uncondensed vapor combines with the vapor rising from the lower absorbing section to form the cold distillation stream 38 leaving the upper region of separator/absorber 52 at −141° F. The condensed liquid portion of stream 34*a* becomes the cold liquid falling downward which contacts the vapor portions of the warmed expanded stream 42*d* and the expanded stream 32*a* rising upward through the absorbing section of separator/absorber 52, condensing and absorbing the ethane and heavier components contained in the vapor.

Demethanizer 14 operates at a pressure of approximately 385 psia. The liquid product stream 37 exits the bottom of the demethanizer at 93° F. (based on a typical specification of a methane to ethane ratio of 0.02:1 on a molar basis in the bottom product) and flows to subsequent processing and/or storage. The overhead vapor distillation stream 34 at −104° F. from the upper region of demethanizer 14 is partially condensed and supplied to separator/absorber 52 at a top feed position as described earlier.

The distillation stream leaving the upper region of separator/absorber 52 is the cold residue gas stream 38, which passes countercurrently to a portion (stream 42*a*) of the feed gas in heat exchanger 54 where it is warmed to −57° F. (stream 38*a*) as it provides further cooling and substantial condensation of stream 42*b*. The cool residue gas stream 38*a* is then divided into two portions, streams 47 and 48. Streams 47 and 48 pass countercurrently to the feed gas in heat exchangers 53 and 10, respectively, and are warmed to 80° F. and 93° F. (streams 47*a* and 48*a*, respectively) as the streams provide cooling and partial condensation of the feed gas. The two warmed streams 47*a* and 48*a* then recombine as residue gas stream 38*b* at a temperature of 86° F. This recombined stream is then re-compressed in two stages. The first stage is compressor 51 driven by expansion machine 50. The second stage is compressor 20 driven by a supplemental power source. The compressed stream 38*d* is then cooled to 105° F. by heat exchanger 21 before the residue gas product (stream 38*e*) flows to the sales gas pipeline at the new line pressure of 840 psia.

A summary of stream flow rates and energy consumptions for the process illustrated in FIG. 5 is set forth in the table below:

TABLE V (FIG. 5)
Stream Flow Summary - (Lb. Moles/Hr)

| Stream | Methane | Ethane | Propane | Butanes+ | Total |
|---|---|---|---|---|---|
| 31 | 17898 | 1441 | 636 | 594 | 20913 |
| 41 | 12529 | 1009 | 445 | 416 | 14640 |
| 42 | 5369 | 432 | 191 | 178 | 6273 |
| 32 | 11698 | 756 | 220 | 83 | 12989 |
| 33 | 831 | 253 | 225 | 333 | 1651 |
| 34 | 2572 | 124 | 7 | 1 | 2723 |

TABLE V-continued (FIG. 5)
Stream Flow Summary - (Lb. Moles/Hr)

| | | | | | |
|---|---|---|---|---|---|
| 46 | 1765 | 1113 | 415 | 262 | 3585 |
| 38 | 17874 | 199 | 3 | 0 | 18400 |
| 37 | 24 | 1242 | 633 | 594 | 2513 |
| | Recoveries* | | | | |
| | Ethane | | | 86.20% | |
| | Propane | | | 99.52% | |
| | Butanes+ | | | 99.99% | |
| | Horsepower | | | | |
| | Residue Compression | | | 9,776 | |
| | Refrigeration Compression | | | 2,947 | |
| | Total | | | 12,723 | |
| | Utility Heat, MBTU/Hr | | | | |
| | Demethanizer Reboilers | | | 14,492 | |

*(Based on un-rounded flow rates)

As before for the FIG. 3 process, the present invention as applied in FIG. 5 can achieve a 27 percent increase in gas processing capacity. In addition, however, with only a minor adjustment in processing conditions and feed stream arrangement, the FIG. 5 process can recover 86.20% of the ethane contained in the feed gas, plus 99.52% of the propane and 99.99% of the butanes+, with no increase in operating utilities. The only significant differences between the present invention as depicted in FIG. 3 and as depicted in FIG. 5 is the feed location of the warmed expanded stream 42*d* and the amount of heat supplied to tower 14 by side reboiler 15 and reboiler 16. These two simple changes allow the present invention to switch from high propane recovery with near complete ethane rejection (FIG. 3) to high ethane recovery (FIG. 5). This allows the plant operator to easily adjust plant operations to produce maximum product revenues as the prices of natural gas and ethane product fluctuate.

Other Embodiments

In accordance with this invention, it is generally advantageous to design the separator/absorber to provide a contacting device composed of multiple theoretical separation stages. However, the benefits of the present invention can be achieved with as few as one theoretical stage, and it is believed that even the equivalent of a fractional theoretical stage may allow achieving these benefits. For instance, all or a part of the partially condensed stream leaving heat exchanger 56 and all or a part of the partially condensed stream from work expansion machine 50 in FIGS. 3, 4, and 5 can be combined (such as in the piping joining the expansion machine to the separator/absorber) and if thoroughly intermingled, the vapors and liquids will mix together and separate in accordance with the relative volatilities of the various components of the total combined streams. In such an embodiment, the vapor-liquid mixture from heat exchanger 56 can be used without separation, or the liquid portion thereof may be separated. Such commingling of the two streams shall be considered for the purposes of this invention as constituting a contacting device. In another variation of the foregoing, the partially condensed stream from heat exchanger 56 can be separated, and then all or a part of the separated liquid supplied to the separator/absorber or mixed with the vapors fed thereto.

As described earlier in the preferred embodiments, the overhead vapors from the deethanizer (or demethanizer) are partially condensed and used to absorb valuable $C_2$ components, $C_3$ components, and heavier components from the vapors leaving the work expansion machine. However, the present invention is not limited to this embodiment. It may be advantageous, for instance, to treat only a portion of the outlet vapor from the work expansion machine in this manner, or to use only a portion of the overhead condensate as an absorbent, in cases where other design considerations indicate portions of the expansion machine outlet or overhead condensate should bypass the separator/absorber. Feed gas conditions, plant size, available equipment, or other factors may indicate that elimination of work expansion machine 50, or replacement with an alternative expansion device (such as an expansion valve), is feasible, or that total (rather than partial) condensation of the overhead stream in heat exchanger 56 is possible or is preferred.

Figure 6:
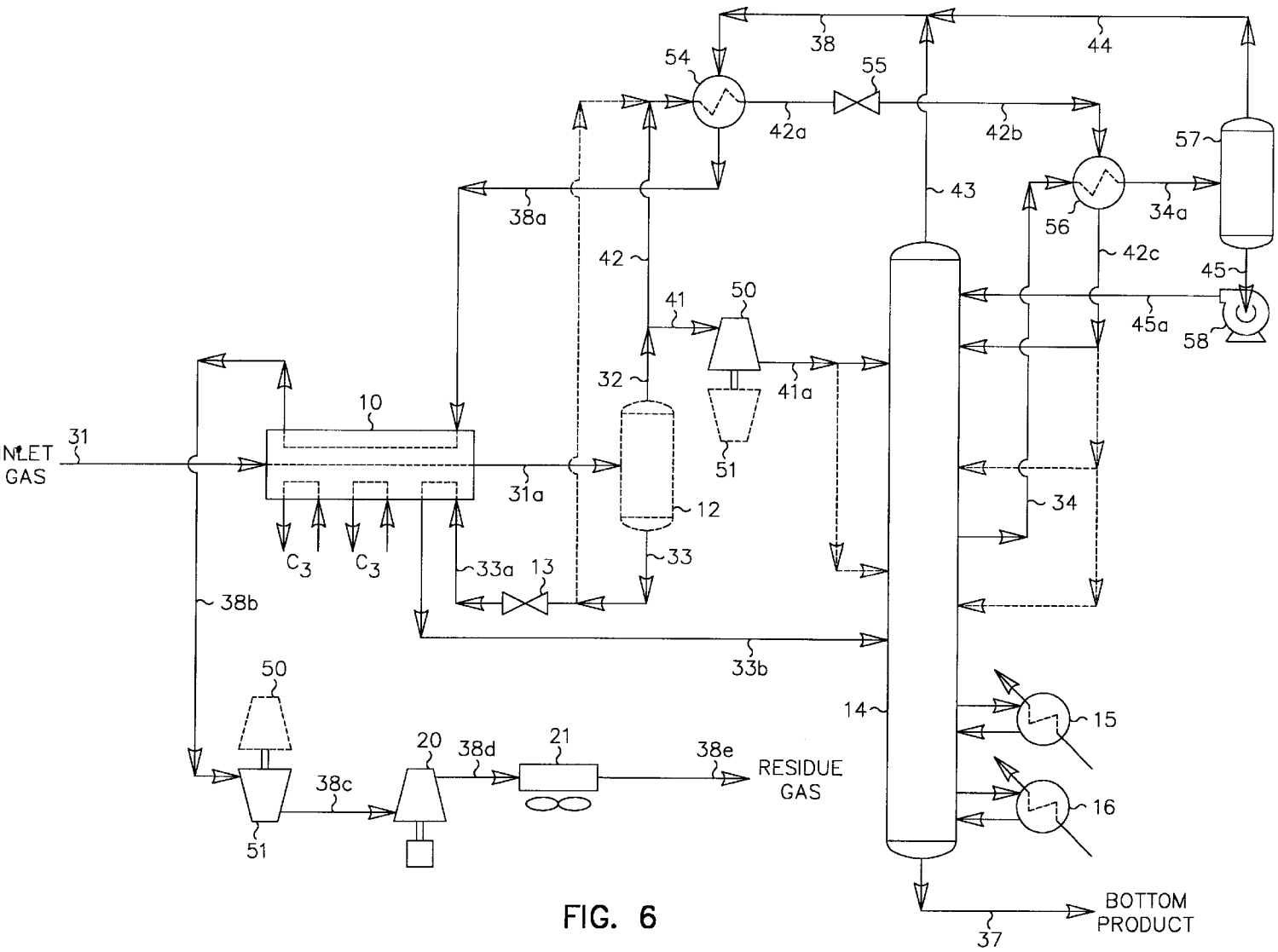
FIG. 6 is a flow diagram illustrating an alternative means of application of the present invention to a natural gas stream.

It should also be noted that the separator/absorber can be constructed either as a separate vessel or as a section of the deethanizer (or demethanizer) column. For example, FIG. 6 illustrates how the present invention might be applied in the case of a new plant installation (rather than modification of an existing processing plant as heretofore described) with a single fractionation column containing both a separator/absorber section and a deethanizing (or demethanizing) section. In this embodiment of the present invention, distillation stream 34 is withdrawn from the upper region of the deethanizing (or demethanizing) section contained in fractionation tower 14 and directed to heat exchanger 56. The distillation stream is cooled and partially condensed by heat exchange with the substantially condensed and flash expanded stream 42*b*, and the partially condensed stream 34*a* then enters reflux separator 57 where the condensed liquid (stream 45) is separated from the uncondensed vapor (stream 44). The condensed liquid is supplied to fractionation tower 14 at a top feed position by reflux pump 58 as stream 45*a* to provide reflux for the separator/absorber section in the top of the tower. The uncondensed vapor (stream 44) joins the tower overhead (stream 43) to form the cold residue gas, stream 38. The warmed expanded stream 42*c* leaving heat exchanger 56 is supplied to fractionation tower 14 at a mid-column feed point. Depending on whether the plant is operated to recover the $C_2$+ components or the $C_3$+ components in the bottom product, the feed gas composition and conditions, and other factors, the optimum feed location for stream 42*c* may be above the work expanded stream 41*a*, below the work expanded stream 41*a* but above the withdrawal point of distillation stream 34, or below the withdrawal point of distillation stream 34, or any combination thereof. Similarly, the optimum feed location for expanded stream 41*a* may be above the withdrawal point of distillation stream 34, or below the withdrawal point of distillation stream 34, or any combination thereof. The choice between the dual column arrangement depicted in FIGS. 3, 4, and 5 and the single column arrangement (requiring a reflux separator and reflux pump) will depend on a number of factors including, but notlimited to, feed gas composition and conditions, plant size, equipment availability, etc.

In the practice of the present invention as depicted in FIGS. 3, 4, and 5, there will necessarily be a slight pressure difference between the deethanizer (or demethanizer) and the separator/absorber which must be taken into account. If the overhead vapors pass through heat exchanger 56 and into separator/absorber 52 without any boost in pressure, the separator/absorber shall necessarily assume an operating pressure slightly below the operating pressure of deethanizer (or demethanizer) 14. In this case, the combined liquid stream withdrawn from the separator/absorber can be pumped to its feed position in the deethanizer (or demethanizer). An alternative is to provide a booster blower in the vapor line to raise the operating pressure in heat exchanger 56 and separator/absorber 52 sufficiently so that the combined liquid stream can be supplied to deethanizer (or demethanizer) 14 without pumping. Still another alternative is to mount separator/absorber 52 at a sufficient elevation relative to the feed position on deethanizer (or demethanizer) 14 so that the hydrostatic head of the liquid will overcome the pressure difference.

The use and distribution of the separator liquids and the separator/absorber liquids for process heat exchange, the particular arrangement of heat exchangers for feed gas cooling, the choice of process streams for specific heat exchange services, and the use of external refrigeration to supplement the cooling available to the feed gas from other process streams must be evaluated for each particular application.

The high pressure liquid stream 33 in FIGS. 3 through 6 need not be expanded through an expansion valve, heated, and fed to a mid-column feed point on the distillation column. Some or all of this stream may be combined with the portion of the feed gas (stream 42*a* in FIGS. 3, 4, and 5) or the separator vapor (stream 42 in FIG. 6) flowing to heat exchanger 54.

In accordance with this invention, the splitting of the vapor feed may be accomplished in several ways. In the processes of FIGS. 3, 4, and 5, the high pressure feed gas is split prior to any cooling of the feed gas. In the process of FIG. 6, the splitting of vapor occurs following cooling and separation of any liquids which may have been formed. Alternatively, the feed gas could be split after cooling of the gas and prior to any separation stages. In some embodiments, vapor splitting may be effected in a separator. Alternatively, the separator 12 in the processes shown in FIGS. 3 through 6 may be unnecessary if the feed gas is relatively lean. Moreover, the use of external refrigeration to supplement the cooling available to the feed gas from other process streams may be unnecessary, particularly in the case of a feed gas leaner than that used in Example 1. The use and distribution of deethanizer (or demethanizer) liquids for process heat exchange, and the particular arrangement of heat exchangers for feed gas cooling must be evaluated for each particular application, as well as the choice of process streams for specific heat exchange services.

It will also be recognized that the relative amount of feed found in each branch of the split vapor feed will depend on several factors, including gas pressure, feed gas composition, the amount of heat which can economically be extracted from the feed and the quantity of horsepower available. More feed to the column in the branch that is substantially condensed, expanded, and used to partially condense the distillation stream may increase recovery while decreasing power recovered from the work expansion machine thereby increasing the recompression horsepower requirements. Increasing feed to the work expansion machine reduces the horsepower consumption but may also reduce product recovery. The mid-column feed positions depicted in FIGS. 3 through 6 are the preferred feed locations for the process operating conditions described. However, the relative locations of the mid-column feeds may vary depending on feed gas composition or other factors such as desired recovery levels and amount of liquid formed during feed gas cooling. Moreover, two or more of the feed streams, or portions thereof, may be combined depending on the relative temperatures and quantities of individual streams, and the combined stream then fed to a mid-column feed position. FIGS. 3 and 5 are the preferred embodiments for the compositions and operating conditions shown. Although individual stream expansion is depicted in particular expansion devices, alternative expansion means may be employed where appropriate. For example, conditions may warrant work expansion of the substantially condensed portion of the feed stream (stream 42*b* in FIGS. 3, 4, and 5) or the substantially condensed portion of the separator vapor (stream 42*a* in FIG. 6).

While there have been described what are believed to be preferred embodiments of the invention, those skilled in the art will recognize that other and further modifications may be made thereto, e.g. to adapt the invention to various conditions, types of feed or other requirements without departing from the spirit of the present invention as defined by the following claims.

We claim:

1. In a process for the separation of a gas stream containing methane, $C_2$ components, $C_3$ components and heavier hydrocarbon components into a volatile residue gas fraction and a relatively less volatile fraction containing said $C_2$ components, $C_3$ components and heavier hydrocarbon components or said $C_3$ components and heavier hydrocarbon components, in which process (a) said gas stream is divided into gaseous first and second streams;

(b) said gaseous first stream is cooled under pressure to condense substantially all of it and is thereafter expanded to a lower pressure whereby it is further cooled;

(c) said gaseous second stream is cooled under pressure and is thereafter expanded to said lower pressure; and (d) said cooled expanded first and second streams are fractionated at said lower pressure whereby the components of said relatively less volatile fraction are recovered;

the improvement wherein (1) said expanded cooled first stream is directed into heat exchange relation with a warmer distillation stream which rises from fractionation stages of a distillation column, thereby cooling said distillation stream sufficiently to at least partially condense it;

(2) at least a portion of said cooled expanded second stream is intimately contacted with at least a portion of said at least partially condensed distillation stream in a contacting device containing at least a fractional theoretical separation stage, and thereafter the vapors and liquids from said contacting device are separated;

(3) said liquids thereby recovered are supplied to said distillation column as a liquid feed thereto;

(4) said vapors thereby recovered are directed into heat exchange relation with said gaseous first stream thereby to heat said vapors and supply said cooling of step (b), whereupon said heated vapors are thereafter discharged as said volatile residue gas fraction; and (5) the quantities and temperatures of said feed streams to said contacting device and said distillation column are effective to maintain the overhead temperatures of said contacting device and said distillation column at temperatures whereby the major portions of the components in said relatively less volatile fraction are recovered.

2. In a process for the separation of a gas stream containing methane, $C_2$ components, $C_3$ components and heavier hydrocarbon components into a volatile residue gas fraction and a relatively less volatile fraction containing said $C_2$ components, $C_3$ components and heavier hydrocarbon components or said $C_3$ components and heavier hydrocarbon components, in which process (a) said gas stream is cooled under pressure and then divided into gaseous first and second streams;

(b) said gaseous first stream is cooled under pressure to condense substantially all of it and is thereafter expanded to a lower pressure whereby it is further cooled;

(c) said gaseous second stream is expanded to said lower pressure; and (d) said cooled expanded first stream and said expanded second stream are fractionated at said lower pressure whereby the components of said relatively less volatile fraction are recovered;

the improvement wherein (1) said expanded cooled first stream is directed into heat exchange relation with a warmer distillation stream which rises from fractionation stages of a distillation column, thereby cooling said distillation stream sufficiently to at least partially condense it;

(2) at least a portion of said expanded second stream is intimately contacted with at least a portion of said at least partially condensed distillation stream in a contacting device containing at least a fractional theoretical separation stage, and thereafter the vapors and liquids from said contacting device are separated;

(3) said liquids thereby recovered are supplied to said distillation column as a liquid feed thereto;

(4) said vapors thereby recovered are directed into heat exchange relation with said gaseous first stream thereby to heat said vapors and supply said cooling of step (b), whereupon said heated vapors are thereafter discharged as said volatile residue gas fraction; and (5) the quantities and temperatures of said feed streams to said contacting device and said distillation column are effective to maintain the overhead temperatures of said contacting device and said distillation column at temperatures whereby the major portions of the components in said relatively less volatile fraction are recovered.

3. In a process for the separation of a gas stream containing methane, $C_2$ components, $C_3$ components and heavier hydrocarbon components into a volatile residue gas fraction and a relatively less volatile fraction containing said $C_2$ components, $C_3$ components and heavier hydrocarbon components or said $C_3$ components and heavier hydrocarbon components, in which process (a) said gas stream is divided into gaseous first and second streams;

(b) said gaseous first stream is cooled under pressure to condense substantially all of it and is thereafter expanded to a lower pressure whereby it is further cooled;

(c) said gaseous second stream is cooled under pressure sufficiently to partially condense it and separated thereby to provide a vapor stream and a condensed stream;

(d) said vapor stream is expanded to said lower pressure;

(e) said condensed stream is expanded to said lower pressure; and (f) said cooled expanded first stream, said expanded vapor stream, and said expanded condensed stream are fractionated at said lower pressure whereby the components of said relatively less volatile fraction are recovered;

the improvement wherein (1) said expanded cooled first stream is directed into heat exchange relation with a warmer distillation stream which rises from fractionation stages of a distillation column, thereby cooling said distillation stream sufficiently to at least partially condense it;

(2) at least a portion of said expanded vapor stream is intimately contacted with at least a portion of said at least partially condensed distillation stream in a contacting device containing at least a fractional theoretical separation stage, and thereafter the vapors and liquids from said contacting device are separated;

(3) said liquids thereby recovered are supplied to said distillation column as a liquid feed thereto;

(4) said vapors thereby recovered are directed into heat exchange relation with said gaseous first stream thereby to heat said vapors and supply said cooling of step (b), whereupon said heated vapors are thereafter discharged as said volatile residue gas fraction; and (5) the quantities and temperatures of said feed streams to said contacting device and said distillation column are effective to maintain the overhead temperatures of said contacting device and said distillation column at temperatures whereby the major portions of the components in said relatively less volatile fraction are recovered.

4. In a process for the separation of a gas stream containing methane, $C_2$ components, $C_3$ components and heavier hydrocarbon components into a volatile residue gas fraction and a relatively less volatile fraction containing said $C_2$ components, $C_3$ components and heavier hydrocarbon components or said $C_3$ components and heavier hydrocarbon components, in which process (a) said gas stream is cooled under pressure and then divided into gaseous first and second streams;

(b) said gaseous first stream is cooled under pressure to condense substantially all of it and is thereafter expanded to a lower pressure whereby it is further cooled;

(c) said gaseous second stream is cooled under pressure sufficiently to partially condense it and separated thereby to provide a vapor stream and a condensed stream;

(d) said vapor stream is expanded to said lower pressure;

(e) said condensed stream is expanded to said lower pressure; and (f) said cooled expanded first stream, said expanded vapor stream, and said expanded condensed stream are fractionated at said lower pressure whereby the components of said relatively less volatile fraction are recovered;

the improvement wherein (1) said expanded cooled first stream is directed into heat exchange relation with a warmer distillation stream which rises from fractionation stages of a distillation column, thereby cooling said distillation stream sufficiently to at least partially condense it;

(2) at least a portion of said expanded vapor stream is intimately contacted with at least a portion of said at least partially condensed distillation stream in a contacting device containing at least a fractional theoretical separation stage, and thereafter the vapors and liquids from said contacting device are separated;

(3) said liquids thereby recovered are supplied to said distillation column as a liquid feed thereto;

(4) said vapors thereby recovered are directed into heat exchange relation with said gaseous first stream thereby to heat said vapors and supply said cooling of step (b), whereupon said heated vapors are thereafter discharged as said volatile residue gas fraction; and (5) the quantities and temperatures of said feed streams to said contacting device and said distillation column are effective to maintain the overhead temperatures of said contacting device and said distillation column at temperatures whereby the major portions of the components in said relatively less volatile fraction are recovered.

5. In a process for the separation of a gas stream containing methane, $C_2$ components, $C_3$ components and heavier hydrocarbon components into a volatile residue gas fraction and a relatively less volatile fraction containing said $C_2$ components, $C_3$ components and heavier hydrocarbon components or said $C_3$ components and heavier hydrocarbon components, in which process (a) said gas stream is cooled under pressure sufficiently to partially condense it and separated thereby to provide a vapor stream and a condensed stream;

(b) said vapor stream is divided into gaseous first and second streams;

(c) said gaseous first stream is cooled under pressure to condense substantially all of it and is thereafter expanded to a lower pressure whereby it is further cooled;

(d) said gaseous second stream is expanded to said lower pressure;

(e) said condensed stream is expanded to said lower pressure; and (f) said cooled expanded first stream, said expanded second stream, and said expanded condensed stream are fractionated at said lower pressure whereby the components of said relatively less volatile fraction are recovered;

the improvement wherein (1) said expanded cooled first stream is directed into heat exchange relation with a warmer distillation stream which rises from fractionation stages of a distillation column, thereby cooling said distillation stream sufficiently to at least partially condense it;

(2) at least a portion of said expanded second stream is intimately contacted with at least a portion of said at least partially condensed distillation stream in a contacting device containing at least a fractional theoretical separation stage, and thereafter the vapors and liquids from said contacting device are separated;

(3) said liquids thereby recovered are supplied to said distillation column as a liquid feed thereto;

(4) said vapors thereby recovered are directed into heat exchange relation with said gaseous first stream thereby to heat said vapors and supply said cooling of step (c), whereupon said heated vapors are thereafter discharged as said volatile residue gas fraction; and (5) the quantities and temperatures of said feed streams to said contacting device and said distillation column are effective to maintain the overhead temperatures of said contacting device and said distillation column at temperatures whereby the major portions of the components in said relatively less volatile fraction are recovered.

6. In a process for the separation of a gas stream containing methane, $C_2$ components, $C_3$ components and heavier hydrocarbon components into a volatile residue gas fraction and a relatively less volatile fraction containing said $C_2$ components, $C_3$ components and heavier hydrocarbon components or said $C_3$ components and heavier hydrocarbon components, in which process (a) said gas stream is cooled under pressure sufficiently to partially condense it and separated thereby to provide a vapor stream and a condensed stream;

(b) said vapor stream is divided into gaseous first and second streams;

(c) said gaseous first stream is combined with at least a portion of said condensed stream to form a combined stream;

(d) said combined stream is cooled under pressure to condense substantially all of it and is thereafter expanded to a lower pressure whereby it is further cooled;

(e) said gaseous second stream is expanded to said lower pressure; and (f) said cooled expanded combined stream, said expanded second stream, and any remaining portion of said condensed stream are fractionated at said lower pressure whereby the components of said relatively less volatile fraction are recovered;

the improvement wherein (1) said expanded cooled combined stream is directed into heat exchange relation with a warmer distillation stream which rises from fractionation stages of a distillation column, thereby cooling said distillation stream sufficiently to at least partially condense it;

(2) at least a portion of said expanded second stream is intimately contacted with at least a portion of said at least partially condensed distillation stream in a contacting device containing at least a fractional theoretical separation stage, and thereafter the vapors and liquids from said contacting device are separated;

(3) said liquids thereby recovered are supplied to said distillation column as a liquid feed thereto;

(4) said vapors thereby recovered are directed into heat exchange relation with said combined stream thereby to heat said vapors and supply said cooling of step (d), whereupon said heated vapors are thereafter discharged as said volatile residue gas fraction; and (5) the quantities and temperatures of said feed streams to said contacting device and said distillation column are effective to maintain the overhead temperatures of said contacting device and said distillation column at temperatures whereby the major portions of the components in said relatively less volatile fraction are recovered.

7. The improvement according to claims 1, 2, 3, 4, 5, or 6 wherein at least a portion of said liquids separated from said contacting device are heated before being supplied to said distillation column as a feed thereto.

8. The improvement according to claims 1, 2, 3, 4, or 5 wherein (a) vapor is separated from said at least partially condensed distillation stream before entering said contacting device, forming a residual vapor stream; and (b) said residual vapor stream is combined with said vapors separated from said contacting device to form said volatile residue gas fraction, whereupon said volatile residue gas fraction is directed into heat exchange relation with said gaseous first stream thereby to heat said volatile residue gas fraction and supply said cooling of said gaseous first stream.

9. The improvement according to claim 6 wherein (a) vapor is separated from said at least partially condensed distillation stream before entering said contacting device, forming a residual vapor stream; and (b) said residual vapor stream is combined with said vapors separated from said contacting device to form said volatile residue gas fraction, whereupon said volatile residue gas fraction is directed into heat exchange relation with said combined stream thereby to heat said volatile residue gas fraction and supply said cooling of said combined stream.

10. In an apparatus for the separation of a gas stream containing methane, $C_2$ components, $C_3$ components and heavier hydrocarbon components into a volatile residue gas fraction and a relatively less volatile fraction containing said $C_2$ components, $C_3$ components and heavier hydrocarbon components or said $C_3$ components and heavier hydrocarbon components, in said apparatus there being (a) a dividing means to divide said gas stream into gaseous first and second streams;

(b) a first heat exchange means connected to said dividing means to receive said gaseous first stream and to cool it under pressure sufficiently to substantially condense it;

(c) a first expansion means connected to said first heat exchange means to receive said substantially condensed first stream and to expand it to a lower pressure, whereby said stream is further cooled;

(d) a cooling means connected to said dividing means to receive said gaseous second stream and to cool it under pressure;

(e) a second expansion means connected to said cooling means to receive said cooled second stream and to expand it to said lower pressure; and (f) a fractionation tower connected to said first expansion means and said second expansion means to receive said expanded streams therefrom;

the improvement wherein said apparatus includes (1) a second heat exchange means connected to said first expansion means to receive said expanded cooled first stream, said second heat exchange means being further connected to said fractionation tower to receive a warmer distillation stream which rises from fractionation stages of a distillation column in said fractionation tower, thereby cooling said distillation stream sufficiently to at least partially condense it;

(2) a contacting and separating means connected to receive at least a portion of said at least partially condensed distillation stream and at least a portion of said cooled expanded second stream wherein said streams are commingled in at least one contacting device, said contacting and separating means including separating means to separate the vapor and liquid after contact in said contacting device to form a vapor stream and a liquid stream, said contacting and separating means being further connected to supply said liquid stream to said distillation column in said fractionation tower as a liquid feed thereto;

(3) said contacting and separating means being further connected to supply said vapor stream to said first heat exchange means to heat said vapor stream and thereby supply the cooling of step (b), whereupon said heated vapor stream is thereafter discharged as said volatile residue gas fraction; and (4) control means adapted to regulate the quantities and temperatures of said feed streams to said contacting and separating means and said fractionation tower to maintain the overhead temperatures of said contacting and separating means and said fractionation tower at temperatures whereby the major portions of the components in said relatively less volatile fraction are recovered.

11. In an apparatus for the separation of a gas stream containing methane, $C_2$ components, $C_3$ components and heavier hydrocarbon components into a volatile residue gas fraction and a relatively less volatile fraction containing said $C_2$ components, $C_3$ components and heavier hydrocarbon components or said $C_3$ components and heavier hydrocarbon components, in said apparatus there being (a) a cooling means to cool said gas stream under pressure;

(b) a dividing means connected to said cooling means to receive said cooled gas stream and to divide it into gaseous first and second streams;

(c) a first heat exchange means connected to said dividing means to receive said gaseous first stream and to cool it under pressure sufficiently to substantially condense it;

(d) a first expansion means connected to said first heat exchange means to receive said substantially condensed first stream and to expand it to a lower pressure, whereby said stream is further cooled;

(e) a second expansion means connected to said dividing means to receive said gaseous second stream and to expand it to said lower pressure; and (f) a fractionation tower connected to said first expansion means and said second expansion means to receive said expanded streams therefrom;

the improvement wherein said apparatus includes (1) a second heat exchange means connected to said first expansion means to receive said expanded cooled first stream, said second heat exchange means being further connected to said fractionation tower to receive a warmer distillation stream which rises from fractionation stages of a distillation column in said fractionation tower, thereby cooling said distillation stream sufficiently to at least partially condense it;

(2) a contacting and separating means connected to receive at least a portion of said at least partially condensed distillation stream and at least a portion of said expanded second stream wherein said streams are commingled in at least one contacting device, said contacting and separating means including separating means to separate the vapor and liquid after contact in said contacting device to form a vapor stream and a liquid stream, said contacting and separating means being further connected to supply said liquid stream to said distillation column in said fractionation tower as a liquid feed thereto;

(3) said contacting and separating means being further connected to supply said vapor stream to said first heat exchange means to heat said vapor stream and thereby supply the cooling of step (c), whereupon said heated vapor stream is thereafter discharged as said volatile residue gas fraction; and (4) control means adapted to regulate the quantities and temperatures of said feed streams to said contacting and separating means and said fractionation tower to maintain the overhead temperatures of said contacting and separating means and said fractionation tower at temperatures whereby the major portions of the components in said relatively less volatile fraction are recovered.

12. In an apparatus for the separation of a gas stream containing methane, $C_2$ components, $C_3$ components and heavier hydrocarbon components into a volatile residue gas fraction and a relatively less volatile fraction containing said $C_2$ components, $C_3$ components and heavier hydrocarbon components or said $C_3$ components and heavier hydrocarbon components, in said apparatus there being (a) a dividing means to divide said gas stream into gaseous first and second streams;

(b) a first heat exchange means connected to said dividing means to receive said gaseous first stream and to cool it under pressure sufficiently to substantially condense it;

(c) a first expansion means connected to said first heat exchange means to receive said substantially condensed first stream and to expand it to a lower pressure, whereby said stream is further cooled;

(d) a cooling means connected to said dividing means to receive said gaseous second stream and to cool it under pressure sufficiently to partially condense it;

(e) a separation means connected to said cooling means to receive said cooled second stream and separate it thereby to provide a first vapor stream and a condensed stream;

(f) a second expansion means connected to said separation means to receive said first vapor stream and to expand it to said lower pressure;

(g) a third expansion means connected to said separation means to receive said condensed stream and to expand it to said lower pressure; and (h) a fractionation tower connected to said first expansion means, said second expansion means, and said third expansion means to receive said expanded streams therefrom;

the improvement wherein said apparatus includes (1) a second heat exchange means connected to said first expansion means to receive said expanded cooled first stream, said second heat exchange means being further connected to said fractionation tower to receive a warmer distillation stream which rises from fractionation stages of a distillation column in said fractionation tower, thereby cooling said distillation stream sufficiently to at least partially condense it;

(2) a contacting and separating means connected to receive at least a portion of said at least partially condensed distillation stream and at least a portion of said expanded first vapor stream wherein said streams are commingled in at least one contacting device, said contacting and separating means including separating means to separate the vapor and liquid after contact in said contacting device to form a second vapor stream and a liquid stream, said contacting and separating means being further connected to supply said liquid stream to said distillation column in said fractionation tower as a liquid feed thereto;

(3) said contacting and separating means being further connected to supply said second vapor stream to said first heat exchange means to heat said second vapor stream and thereby supply the cooling of step (b), whereupon said heated second vapor stream is thereafter discharged as said volatile residue gas fraction; and (4) control means adapted to regulate the quantities and temperatures of said feed streams to said contacting and separating means and said fractionation tower to maintain the overhead temperatures of said contacting and separating means and said fractionation tower at temperatures whereby the major portions of the components in said relatively less volatile fraction are recovered.

13. In an apparatus for the separation of a gas stream containing methane, $C_2$ components, $C_3$ components and heavier hydrocarbon components into a volatile residue gas fraction and a relatively less volatile fraction containing said $C_2$ components, $C_3$ components and heavier hydrocarbon components or said $C_3$ components and heavier hydrocarbon components, in said apparatus there being (a) a first cooling means to cool said gas stream under pressure;

(b) a dividing means connected to said first cooling means to receive said cooled gas stream and to divide it into gaseous first and second streams;

(c) a first heat exchange means connected to said dividing means to receive said gaseous first stream and to cool it under pressure sufficiently to substantially condense it;

(d) a first expansion means connected to said first heat exchange means to receive said substantially condensed first stream and to expand it to a lower pressure, whereby said stream is further cooled;

(e) a second cooling means connected to said dividing means to receive said gaseous second stream and to cool it under pressure sufficiently to partially condense it;

(f) a separation means connected to said second cooling means to receive said cooled second stream and separate it thereby to provide a first vapor stream and a condensed stream;

(g) a second expansion means connected to said separation means to receive said first vapor stream and to expand it to said lower pressure;

(h) a third expansion means connected to said separation means to receive said condensed stream and to expand it to said lower pressure; and (i) a fractionation tower connected to said first expansion means, said second expansion means, and said third expansion means to receive said expanded streams therefrom;

the improvement wherein said apparatus includes (1) a second heat exchange means connected to said first expansion means to receive said expanded cooled first stream, said second heat exchange means being further connected to said fractionation tower to receive a warmer distillation stream which rises from fractionation stages of a distillation column in said fractionation tower, thereby cooling said distillation stream sufficiently to at least partially condense it;

(2) a contacting and separating means connected to receive at least a portion of said at least partially condensed distillation stream and at least a portion of said expanded first vapor stream wherein said streams are commingled in at least one contacting device, said contacting and separating means including separating means to separate the vapor and liquid after contact in said contacting device to form a second vapor stream and a liquid stream, said contacting and separating means being further connected to supply said liquid stream to said distillation column in said fractionation tower as a liquid feed thereto;

(3) said contacting and separating means being further connected to supply said second vapor stream to said first heat exchange means to heat said second vapor stream and thereby supply the cooling of step (c), whereupon said heated second vapor stream is thereafter discharged as said volatile residue gas fraction; and (4) control means adapted to regulate the quantities and temperatures of said feed streams to said contacting and separating means and said fractionation tower to maintain the overhead temperatures of said contacting and separating means and said fractionation tower at temperatures whereby the major portions of the components in said relatively less volatile fraction are recovered.

14. In an apparatus for the separation of a gas stream containing methane, $C_2$ components, $C_3$ components and heavier hydrocarbon components into a volatile residue gas fraction and a relatively less volatile fraction containing said $C_2$ components, $C_3$ components and heavier hydrocarbon components or said $C_3$ components and heavier hydrocarbon components, in said apparatus there being (a) a cooling means to cool said gas stream under pressure sufficiently to partially condense it;

(b) a separation means connected to said cooling means to receive said cooled gas stream and separate it thereby to provide a first vapor stream and a condensed stream;

(c) a dividing means connected to said separation means to receive said first vapor stream and to divide it into gaseous first and second streams;

(d) a first heat exchange means connected to said dividing means to receive said gaseous first stream and to cool it under pressure sufficiently to substantially condense it;

(e) a first expansion means connected to said first heat exchange means to receive said substantially condensed first stream and to expand it to a lower pressure, whereby said stream is further cooled;

(f) a second expansion means connected to said dividing means to receive said gaseous second stream and to expand it to said lower pressure;

(g) a third expansion means connected to said separation means to receive said condensed stream and to expand it to said lower pressure; and (h) a fractionation tower connected to said first expansion means, said second expansion means, and said third expansion means to receive said expanded streams therefrom;

the improvement wherein said apparatus includes (1) a second heat exchange means connected to said first expansion means to receive said expanded cooled first stream, said second heat exchange means being further connected to said fractionation tower to receive a warmer distillation stream which rises from fractionation stages of a distillation column in said fractionation tower, thereby cooling said distillation stream sufficiently to at least partially condense it;

(2) a contacting and separating means connected to receive at least a portion of said at least partially condensed distillation stream and at least a portion of said expanded second stream wherein said streams are commingled in at least one contacting device, said contacting and separating means including separating means to separate the vapor and liquid after contact in said contacting device to form a second vapor stream and a liquid stream, said contacting and separating means being further connected to supply said liquid stream to said distillation column in said fractionation tower as a liquid feed thereto;

(3) said contacting and separating means being further connected to supply said second vapor stream to said first heat exchange means to heat said second vapor stream and thereby supply the cooling of step (d), whereupon said heated second vapor stream is thereafter discharged as said volatile residue gas fraction; and (4) control means adapted to regulate the quantities and temperatures of said feed streams to said contacting and separating means and said fractionation tower to maintain the overhead temperatures of said contacting and separating means and said fractionation tower at temperatures whereby the major portions of the components in said relatively less volatile fraction are recovered.

15. In an apparatus for the separation of a gas stream containing methane, $C_2$ components, $C_3$ components and heavier hydrocarbon components into a volatile residue gas fraction and a relatively less volatile fraction containing said $C_2$ components, $C_3$ components and heavier hydrocarbon components or said $C_3$ components and heavier hydrocarbon components, in said apparatus there being (a) a cooling means to cool said gas stream under pressure sufficiently to partially condense it;

(b) a separation means connected to said cooling means to receive said cooled gas stream and separate it thereby to provide a first vapor stream and a condensed stream;

(c) a dividing means connected to said separation means to receive said first vapor stream and to divide it into gaseous first and second streams;

(d) a combining means connected to combine said gaseous first stream and at least a portion of said condensed stream into a combined stream;

(e) a first heat exchange means connected to said combining means to receive said combined stream and to cool it under pressure sufficiently to substantially condense it;

(f) a first expansion means connected to said first heat exchange means to receive said substantially condensed combined stream and to expand it to a lower pressure, whereby said stream is further cooled;

(g) a second expansion means connected to said dividing means to receive said gaseous second stream and to expand it to said lower pressure;

(h) a third expansion means connected to said separation means to receive any remaining portion of said condensed stream and to expand it to said lower pressure; and (i) a fractionation tower connected to said first expansion means, said second expansion means, and said third expansion means to receive said expanded streams therefrom;

the improvement wherein said apparatus includes (1) a second heat exchange means connected to said first expansion means to receive said expanded cooled combined stream, said second heat exchange means being further connected to said fractionation tower to receive a warmer distillation stream which rises from fractionation stages of a distillation column in said fractionation tower, thereby cooling said distillation stream sufficiently to at least partially condense it;

(2) a contacting and separating means connected to receive at least a portion of said at least partially condensed distillation stream and at least a portion of said expanded second stream wherein said streams are commingled in at least one contacting device, said contacting and separating means including separating means to separate the vapor and liquid after contact in said contacting device to form a second vapor stream and a liquid stream, said contacting and separating means being further connected to supply said liquid stream to said distillation column in said fractionation tower as a liquid feed thereto;

(3) said contacting and separating means being further connected to supply said second vapor stream to said first heat exchange means to heat said second vapor stream and thereby supply the cooling of step (e), whereupon said heated second vapor stream is thereafter discharged as said volatile residue gas fraction; and (4) control means adapted to regulate the quantities and temperatures of said feed streams to said contacting and separating means and said fractionation tower to maintain the overhead temperatures of said contacting and separating means and said fractionation tower at temperatures whereby the major portions of the components in said relatively less volatile fraction are recovered.

16. The improvement according to claims 10, 11, 12, 13, 14, or 15 wherein the apparatus includes a heating means connected to said contacting and separating means to receive at least a portion of said liquid stream separated therefrom and heat it, said heating means being further connected to supply said heated stream to said distillation column in said fractionation tower as a feed thereto.

17. The improvement according to claims 10 or 11 wherein the apparatus includes (a) a separation means connected to said second heat exchange means to receive said at least partially condensed distillation stream and separate it thereby to form a residual vapor stream and a liquid reflux stream, said separation means being further connected to supply said liquid reflux stream to said contacting and separating means;

(b) a combining means connected to said separation means to receive said residual vapor stream, said combining means being further connected to said contacting and separating means to receive said vapor stream separated therefrom and combine it with said residual vapor stream to form said volatile residue gas fraction; and (c) said combining means being further connected to supply said volatile residue gas fraction to said first heat exchange means, thereby heating said volatile residue gas fraction and supplying said cooling of said gaseous first stream.

18. The improvement according to claims 12, 13, or 14 wherein the apparatus includes (a) a second separation means connected to said second heat exchange means to receive said at least partially condensed distillation stream and separate it thereby to form a residual vapor stream and a liquid reflux stream, said second separation means being further connected to supply said liquid reflux stream to said contacting and separating means;

(b) a combining means connected to said second separation means to receive said residual vapor stream, said combining means being further connected to said contacting and separating means to receive said second vapor stream separated therefrom and combine it with said residual vapor stream to form said volatile residue gas fraction; and (c) said combining means being further connected to supply said volatile residue gas fraction to said first heat exchange means, thereby heating said volatile residue gas fraction and supplying said cooling of said gaseous first stream.

19. The improvement according to claim 15 wherein the apparatus includes (a) a second separation means connected to said second heat exchange means to receive said at least partially condensed distillation stream and separate it thereby to form a residual vapor stream and a liquid reflux stream, said second separation means being further connected to supply said liquid reflux stream to said contacting and separating means;

(b) a combining means connected to said second separation means to receive said residual vapor stream, said combining means being further connected to said contacting and separating means to receive said second vapor stream separated therefrom and combine it with said residual vapor stream to form said volatile residue gas fraction; and (c) said combining means being further connected to supply said volatile residue gas fraction to said first heat exchange means, thereby heating said volatile residue gas fraction and supplying said cooling of said combined stream.

* * * * *

UNITED STATES PATENT AND TRADEMARK OFFICE

CERTIFICATE OF CORRECTION

PATENT NO. : 5,890,378
DATED : April 6, 1999
INVENTOR(S) : Rambo et al.

It is certified that error appears in the above-identified patent and that said Letters Patent is hereby corrected as shown below:

Title page,
Column 9,
Line 8, "30" should be deleted.

Insert the following item:
-- Item [60] Provisional application No 60/044,569 April 21, 1997 --

Column 1,
Line 4, insert the following -- Cross Reference to Related Application Reference is made to and priority claimer from U.S. provisional application Ser. No. 60/044,569, April 21, 1997. --

Signed and Sealed this

Fourth Day of December, 2001

*Attest:*

Nicholas P. Godici

*Attesting Officer*

NICHOLAS P. GODICI
*Acting Director of the United States Patent and Trademark Office*